US006702391B1

(12) United States Patent
Stipek

(10) Patent No.: US 6,702,391 B1
(45) Date of Patent: Mar. 9, 2004

(54) FURNITURE WITH MOLDED FRAME

(76) Inventor: Grant Stipek, 4320 NE. Twin Spits Rd., Hansville, WA (US) 98340

( * ) Notice: Subject to any disclaimer, the term of this patent is extended or adjusted under 35 U.S.C. 154(b) by 1,369 days.

(21) Appl. No.: 08/474,314

(22) Filed: Jun. 7, 1995

(51) Int. Cl.[7] ..... A47C 7/02

(52) U.S. Cl. ..... 297/452.65; 297/451.13; 297/451.12

(58) Field of Search ..... 297/451.11, 451.12, 297/451.13, 239, 452.22, 440.11, 452.2, 452.65

(56) References Cited

U.S. PATENT DOCUMENTS

| | | | | | |
|---|---|---|---|---|---|
| 2,818,107 | A | * | 12/1957 | Thaden | 297/451.12 X |
| 3,074,203 | A | * | 1/1963 | Paksy | 297/451.11 X |
| 3,669,496 | A | * | 6/1972 | Chisholm | 297/452.65 X |
| 3,719,389 | A | * | 3/1973 | Burton et al. | 297/451.13 X |
| 3,752,533 | A | * | 8/1973 | Gilbert | 297/440.11 X |
| 3,761,130 | A | | 9/1973 | Suzuki et al. | 297/445 |
| 3,826,533 | A | * | 7/1974 | Andrus et al. | 297/445 |
| 3,887,234 | A | | 6/1975 | Curtis et al. | 297/440 |
| 3,964,790 | A | | 6/1976 | Bergeron | 297/445 |
| 3,989,212 | A | * | 11/1976 | Jennings | 297/451.11 X |
| 4,002,369 | A | * | 1/1977 | Jennings | 297/451.11 |
| 4,088,367 | A | * | 5/1978 | Atkinson et al. | 297/452.65 X |
| 4,577,907 | A | | 3/1986 | Talmon et al. | 297/452 |
| 4,660,887 | A | | 4/1987 | Fleming et al. | 297/445 |
| 4,685,739 | A | * | 8/1987 | Deegener et al. | 297/452.65 |
| 5,197,152 | A | * | 3/1993 | Rose et al. | 297/452.22 X |
| 5,342,110 | A | | 8/1994 | Merrick | 297/232 |
| 5,411,316 | A | | 5/1995 | Lovegrove et al. | 297/452.15 |

FOREIGN PATENT DOCUMENTS

| | | | |
|---|---|---|---|
| CH | 361099 | 3/1962 | |
| CH | 468 811 | 4/1969 | A47C/5/12 |
| DE | 20 21 716 | 1/1972 | A47C/5/12 |
| DE | 2518468 | 11/1976 | A47C/7/16 |
| FR | 2201623 | 4/1974 | A47C/3/04 |
| GB | 867457 | 5/1961 | |
| NL | 7509695 | 2/1976 | A47C/5/12 |

OTHER PUBLICATIONS

Lovegrove, *I.D. Magazine*, Jan./Feb. 1996, p. 64.
Eames, Chaise Lounge 1948, *I.D. Magazine*, Jan./Feb. 1996, p. 34.
Burt, "Low Density Space Frames, Based on 'Regular Infinite Polyhedra'", *Elsevier Science Publishers B.V.*, 1986, p. 245, 247, 249.
Rubbermaid, "Sundial Casual Furniture" tag, 1987.
*UDM Upholstery Design & Manufacturing*, Jan. 1994, p. 35, 37.
Giorgina Castiglioni, Canguro, Gufram, 1970.
Eugenio Gerli, S83, Tecno, 1962.
Rodney Kinsman, Bieffeplast, 1970.
Paolo Renoldi, Velca, 1974.
Gostoni Rinaldi, Rima, 1966.
Marco Zanuso, Minisit, Elaim, 1969.
Kazuhide Takahama, Gasina.
Giotta Stoppino, Maia, Bernini, 1969.
Giotto Stoppino, Alessia, Driade, 1970.
Carlo Bartoli, Mito, T70, 1969.
Roberto Pamio, Renato Toso, Linda, Stilwood, 1969.
Vittorio Nobili, Tagliabue, 1955.

(List continued on next page.)

*Primary Examiner*—Peter M. Cuomo
*Assistant Examiner*—Stephen Vu
(74) *Attorney, Agent, or Firm*—Sheridan Ross P.C.

(57) ABSTRACT

A seat having a frame made of a molded article in which the molded article is a shell-structure is described. Preferably the molded article describes a lattice structure in the form of a space frame. The molded article is preferably scaled and contoured providing significant structural integration and torsional strength.

72 Claims, 14 Drawing Sheets

OTHER PUBLICATIONS

Eugenio Gerli, Mario Cristiani, Forma, 1953.
Pierluigi Spadolini, Scilla, ICS, 1958.
Luciano Nustrini, Poltronova, 1957.
Gastone Rinaldi, DU30, Rima, 1953.
Alberto Rosselli, P110, Saporiti, 1971.
Mario Bellini, Amanta, B&B, 1966.
Eleonore Peduzzi, Riva, Zanotta, 1969.
Joe Colombo, Elda, Comfort, 1965.
Richard Neagle, Nike–Auriga, Sormani, 1966.
Gio Ponti, Novedra, B&B, 1971.
Carlo Bartoli, Arflex, 1969.
Pierluigi Spadolini, Boccio, Ipi, 1972.
Superstudio, Sofo, Poltronova, 1966.*
Alberto Rosselli, Jumbo, Saporiti, 1969.*
Giovanni Travasa, Vittorio Bonacina, 1962.*
Sergio Mazza, Toga, Artemide, 1968.*
Maioli Calzavara Guiducci, 695/696, Vittorio Bonacina, 1964.*
Rodolfo Bonetto, Melaina, Driade, 1969.*
Angelo Mangiarotti, Artemide, 1967.*
Sergio Mazza, Mida, Artemide, 1967.*
Carlo Bartoli, Gaia, Arflex, 1967.*
Gae Aulenti, 4974, Kartell, 1975.*
BBB Bonacina, 1970.*
Vico Magistretti, Artemide, 1971.*
Gae Aulenti Kartell, 1968.*
Piero De Martini, Enne Uno, B&B, 1970.*
Giorgina Castiglioni, 4850, Kartell, 1970.*
Joe Colombo, Kartell, 1968.*
Vico Magistretti, Selene, Artemide, 1969.*
Rossi Molinari, Totem, 1968.*
Giovanni Travasa, 827, Vittorio Bonacina, 1966.*
Angelo Mangiarotti, In, Zanotta, 1968.*
Roberto Pamio, Renato Toso, Basket, Stillwood, 1972.*
Aeron Chair, *I.D. Annual Design Review*, 1995, p. 168–169, 185.*
Chazen, "Herman Miller Thinks Outside the Box", *UDM Upholstery Design & Manufacturing*, May 1995, p. 2, 12–15, 18.*

* cited by examiner

FURNITURE WITH MOLDED FRAME

The present invention relates to furniture for seating having a frame, the larger portion of which is made with a molding process. In particular, the invention relates to a frame having molded components which are largely shell-structure, in which a lattice form is defined by the molded components around a recessed or open area e.g., within the seat portion of the seat frame, and which may optionally be upholstered.

Furniture for seating is typically made by providing a weight-bearing frame and, in many cases, a suspension and foam or other padding and upholstery.

A significant portion of seat frames are of conventional construction. The overwhelming majority of upholstered seat frames are of conventional construction. The conventional construction of seat frames is the familiar frame construction seen in most furniture, and especially in most upholstered furniture. In it, conventional materials such as hardwood, softwood, plywood, chipboard, and extruded steel members, are processed by conventional means such as sawing, milling, planing, etc., and joined using conventional materials and methods such as screw and glue joinery, staple gun joinery, welding, rabbeting, and the like. The conventional construction of seat frames is limited as a process of manufacture. The conventional construction of seat frames is limited as regard to the intended use, and potentially desired capabilities for use, of the seat frame. The limitations of conventional construction are particularly significant for seat frames that are upholstered.

Seat frames of conventional construction are poorly equipped to provide higher quality and greater value at modest or reduced cost. The materials and processes of the conventional construction severely limit the range of properties that can be provided in a seat frame, particularly at modest cost. Seat frames of conventional construction are not efficiently produced. Extensive pre-processing of materials is usually required, and assembly processes are usually cumbersome and labor-intensive, leading to poor cost-efficiency. Labor in many cases accounts for nearly 50% of value-added cost of manufacture. The conventional construction can result in inconsistencies in product quality. The high labor content in the manufacturing process is a contributing factor, as are conventional frame materials, particularly wood-based materials, which are often idiosyncratic and inconsistent.

The engineering capabilities in seat frames of conventional construction are limited. The properties, structural and otherwise, that can be engineered into the seat frame, especially at modest cost, are limited. Conventional seat frames are often governed by strict perpendicularity at places of intersection where the component parts join, and the nature of the joinery often provides for non-optimal strength and durability. The design capabilities in seat frames of conventional construction are limited. It is not feasible to produce a generous range of forms, especially at modest cost. Conventional seat frame designs incline to a rigid, rectilinear format. Ergonomic features such as lumbar support, are poorly accommodated. Seat frames of conventional construction are often difficult to recycle, since the hardware used in the joinery frequently differs from the material from which the frame is made and must be removed, often with some difficulty.

The forms that are usually provided within the frames of seat frames of conventional construction are not especially well-suited for use with upholstered furniture. Seat frames of conventional construction tend to provide surfaces that are lean and narrow. Furthermore, components are typically rectangular in cross-section, defining sharp edges. Thus, in such furniture, large quantities of, typically expensive, foam or padding are usually required to provide upholstered furniture which can accommodate the human body with some degree of comfort (overstuffed upholstered furniture being a typical, and frequent, expression of this). And, despite the large quantities of foam or padding usually demanded, coverage of the frame with such foam or padding is usually not complete, often reducing the useful life of the upholstery, often limiting the fabric materials available for use with the upholstered seat frame to "upholstery grade" materials, and often further limiting the ease with which upholstered pieces can be transported (already usually burdened by the relatively great weight of the frames). The (typical) rectilinear format of conventional seat frame designs tends to restrict the ability to facilely produce seat frames or seat frame components that stack or internest.

Some furniture is designed to be "knocked-down" (i.e. disassembled and/or folded so as to occupy a smaller volume than in the normal use configuration). Seat frames of conventional construction typically require added hardware in order for the frames to be knocked-down, adding the cost of fitting and joining such additional hardware to the seat frame. The various seat frame designs must be accommodated to the available knock-down hardware. The material of which such added hardware is made typically differs, both in composition and strength, from the material from which the seat frame is made, resulting in stress raisers (concentrations of stress in a relatively small region) that reduce the durability of the seat frame. The added hardware also makes the seat frame more difficult to recycle. Many knock-down designs are relatively difficult to disassemble and reassemble. Among other things, this has limited the use of knock-down seat frames with modular-like interchangeable parts or sections.

Some furniture provides for relative movement of components (e.g. recliners, sofa beds, seat frames with adjustable headrests or adjustable armrests). In conventional seat frame construction these typically have been produced by joining separate hardware devices (such as hinges and other pivots, sliding hardware and the like) to portions of the frame. These designs suffer from defects similar to those described for knock-down devices (such as cost, limitation of designs to available hardware, stress raisers and difficulty of recycling).

Devices or techniques for therapeutic or comfort enhancement such as massage, heating, pneumatic variable body support, etc. are typically coupled to the seat frame by conventional means. Design and engineering capabilities for the incorporation of such devices or techniques are restricted by the limited engineering capabilities of conventional seat frame construction, i.e. the properties, structural and otherwise, that can be engineered into the seat frame, especially at modest cost. Design and engineering capabilities for the incorporation of such devices or techniques are also restricted by the limited design capabilities of conventional seat frame construction, and the limited range of forms that can be produced, and are at least partially defined by the typically rigid, rectilinear conventional seat frame format.

Because of limitations on design and engineering capabilities in conventional seat frame construction, such as those indicated above, it is impossible for producers of conventional seat frames to fully realize the benefits of modem design tools such as computer-based visualization and 3-D modeling, structural analysis, process simulation, rapid prototyping and computer-driven tools. Limits in design and engineering capabilities also result in a limited range in the choices available for custom-designed and engineered seat frames and upholstered units.

There are fundamentally sound reasons for manufacturing a seat frame comprised largely or entirely of a molded article or molded articles (molded seat frames). The capabilities of molded construction generally, applied to the manufacture of seat frames, can answer to the limitations of the conventional construction of seat frames, limitations both as process of manufacture, and limitations as regard to the intended use, and potentially desired capabilities for use, of the seat frame. The advantages of molded construction are especially useful for seat frames that are upholstered. The presence of molded seat frames has increased in recent years, mostly by way of injection-molded chairs made of plastic. The capabilities of molded construction generally, applied to the manufacture of seat frames, have been only modestly realized. Very few molded seat frames are upholstered.

Molded seat frames are well-equipped to provide higher quality and greater value at modest or reduced cost. Molded seat frames greatly expand the range of properties that can be provided in a seat frame, particularly at modest cost. Molded seat frames can be efficiently produced. Often no pre-processing of materials is necessary, and assembly processes can be simplified or eliminated. Molded seat frames can be produced with consistent product quality. The technology of molding is advanced, and continues to advance.

The engineering capabilities in molded seat frames are broad. The properties, structural and otherwise, that can be engineered into the seat frame, especially at modest cost, are broad. Molded seat frames need not be governed by strict perpendicularity, nor have joinery providing non-optimal strength and durability. The design capabilities in molded seat frames are broad. It is possible to produce a generous range of forms, and at modest cost. Seat frame designs need not incline to a rigid, rectilinear format. Ergonomic features such as lumbar support, can be readily accommodated. Molded seat frames need not be difficult to recycle, as joinery can be made integral, or eliminated entirely.

Molded seat frames are well-suited for use in upholstered furniture. Molded seat frames need not provide surfaces being lean and narrow. Molded seat frames need not be rectangular in cross-section, defining sharp edges. Use of the molded seat frame in upholstered furniture makes special sense. Molding makes a wide range of materials available, and with upholstered furniture the seat frame need not be exposed, so the aesthetic properties of the molded materials need not be a concern. Molded seat frames provide great opportunity to produce seat frames or seat frame components that stack or internest.

Molded seat frames that "knock-down" can be made without added hardware, instead having integral knock-down joinery. Thus, no cost need be incurred in fitting and joining additional hardware to the seat frame, the seat frame designs need not be accommodated to available knock-down hardware, no stress raisers need result that reduce the durability of the seat frame, and the seat frame can be less difficult to recycle. Integral knock-down joinery in molded seat frames can be made to be readily disassembled and reassembled.

Molded seat frames providing for relative movement of components may be made without added hardware, instead having integral joints and the like for motion. The advantages are similar to those described for molded seat frames having integral knock-down joinery (such as cost-savings, the independence of designs from available hardware, reduced stress raisers and increased ease of recycling).

In molded seat frames, devices or techniques for therapeutic or comfort enhancement such as massage, heating, pneumatic variable body support, etc., can be readily incorporated into the seat frame, and by novel means. Design and engineering capabilities for the incorporation of such devices or techniques are enhanced by the broad engineering capabilities of molded seat frames. Design and engineering capabilities for the incorporation of such devices or techniques are enhanced by the broad design capabilities of molded seat frames, and the broad range of forms that can be produced.

Because the design and engineering capabilities in molded seat frames are broad, producers of molded seat frames can fully realize the benefits of modern design tools such as computer-based visualization and 3-D modeling, structural analysis, process simulation, rapid prototyping and computer-driven tools. Broad design and engineering capabilities in molded seat frames also result in a broad range in the choices available for custom-designed and engineered seat frames and upholstered units.

Molded seat frames fall into two fundamental categories, reflecting two generally distinct approaches to the engineering of strength within molded articles: (1) Molded seat frames having an engineering of strength within molded articles largely being as that largely evident in current injection-molded plastic chairs; (2) Molded seat frames having an engineering of strength within molded articles largely being shell-structure (shell-structure molded seat frames). The latter is preferable in many ways, and particularly so for molded seat frames that are upholstered.

In shell-structure molded seat frames, considerable continuity in structural strength in the seat frame, i.e. structural integration, i.e. diminishment of stress raisers between portions of the seat frame, can be readily achieved. This is not the case with current injection-molded plastic chairs, for a distinct discontinuity in structural strength in the seat frame, between the seat portion of the seat frame and surrounding areas, is common and not always easily redressed. Continuity in structural strength makes the seat frame more stable, enhancing strength and durability. It can also reduce the quantities of material required, and make engineered strength more predictable.

In shell-structure molded seat frames, structural properties are enhanced in making the forms wanted for upholstered furniture. Forms that are in size less lean, less narrow, broader, fuller, can enhance overall structural strength in a shell-structure. Forms that are in shape less rectangular, less sharp-edged, more rounded, blunter of edge, preferably generously contoured, can enhance structural integration, durability, efficiency of material use, and torsional strength, in a shell-structure. Shell-structures lend themselves to a disassembly and reassembly through means of overlapping the shell-structure. This can allow for strong, structurally integrated joints, that can be facilely disassembled and reassembled. Shell-structures that are hollow allow a stacking or internesting of the disassembled portions of the seat frame, and through this means, a larger seat frame might be reduced in size to a very modest package.

There are a range of molding processes that by their very nature are inclined to produce shell-structures (molding processes intrinsically descriptive of shell-structures). In shell-structure molded seat frames these molding processes can be utilized, bringing great advantages to the producer. In shell-structure molded seat frames made with molding processes intrinsically descriptive of shell-structures, a way of working a material is fluently integrated with a way of using the so-worked material in the engineering of the structure, incorporating the natural capabilities of a characteristic materials processing with a characteristic structural engineering.

The range of molding processes being intrinsically descriptive of shell-structures makes more molding processes available for shell-structure molded seat frames. Included among these are low-cost molding process options using lower-cost molds and molding machinery (costs should be compared with the injection-molding process of current injection-molded plastic chairs, where mold costs can run to several hundred thousand dollars, for single-seat sized chairs, and the cost of the injection-molding machinery used can run into the millions of dollars). Notable among the low-cost molding options are low-pressure molding processes, such as a process operating at pressures less than about 100 p.s.i., preferably less than 50 p.s.i. These especially can reduce molding costs, allowing lighter, thinner molds, and in some cases facilitating a faster cooling of material, as applicable. In some instances, very lightweight molds can be made having strength mirroring that of the shell-structure molded article. Low-pressure molding processes also enable many variations within the molding process. Complex inter-inflatable moldable forms can be used in low-pressure molding processes. Innovative molding processes such as molds that are an inflatable article can be used. Using molds that are an inflatable article, seat frames can be transported unconstructed and be molded directly by the end user. A canister of material with foaming agent, for example, can be shipped with the inflatable mold. The availability of low-cost molding options, and particularly lower-cost molds, means that large molds (as. for two-seat or three-seat frames) need not be prohibitively expensive. It means a reduction in the size of production runs required to recoup mold costs, so designs can be turned over more readily, increasing design flexibility for producers, and enabling an avoidance of clichéd designs (clichéd designs being common with current injection-molded plastic chairs). It also means producers can affordably keep many molds on hand, and enables frames or components of frames in varying sizes, in varying versions, with varying ergonomic features, and the like.

Many materials, in many states, are accessible with molding processes intrinsically descriptive of shell-structures, making more materials available for use with shell-structure molded seat frames. Among materials available are many alternatives to plastics. The use of plastics in molded seat frames raises environmental considerations, especially questions as to the material's long-term recyclability. But perhaps more importantly, seat frames made of plastic present a fire safety hazard and may not be well-suited for use indoors, especially in homes in the form of upholstered furniture.

The many molding processes intrinsically descriptive of shell-structures, and the many materials accessible through them, provides great flexibility for the producer of shell-structure molded seat frames. There are many options for the producer to choose among molding processes and materials, or molding contractors and material suppliers. The producer can tap this range of molding processes and materials, or molding contractors and material suppliers, for rapid, localized or decentralized growth. Growth may also possibly be attained without heavy capital requirements by tapping the financial base of competing molding contractors and material suppliers seeking avenues for their production. Because of the ability to diversify production, the producer need not be tied to any particular molding process or molding contractor, or material or material supplier. The producer is free to adjust production to accommodate changes in material costs, molding costs, or other concerns. The producer can target various price points in the market, with seat frames made of various materials, or processes. A consumer can purchase a favored seat frame in a lower-cost version (where the seat frame is upholstered, choosing say, to initially focus on premium upholstery), then upgrade later to a more expensive version of the same frame (e.g., stronger and/or more durable, or with additional features such as disassembly, therapeutic features, etc.). The producer is also accorded greater flexibility for incorporating developments in materials and production technology.

Cast-in stresses in molded articles generally are reduced in molding processes intrinsically descriptive of shell-structures, because the molded malleable material, in contacting and taking its shape from the defined, moldable form, is apt to travel in volumes that are broad, and travel at and onto the outer surface area. Cast-in stresses in molded articles can lead to stress-cracking and reduce a molded article's useful life, and are a matter of concern in current injection-molded plastic chairs. The engineering capacity in molded articles produced using molding processes intrinsically descriptive of shell-structures is furthered in that the malleable material, in contacting and taking its shape from the defined form, is apt to travel in volumes that are broad, and travel at and onto the outer surface area, and the material can often be selectively distributed on the outer surface area. With many of the molding processes intrinsically descriptive of shell-structures closed shell construction shell-structures can be readily produced. This is of great value in that closed shell construction shell-structures are particularly well-suited for use in upholstered furniture, providing surface area around all parts of the seat frame. Further, closed shell construction shell-structures can enhance the torsional strength and durability of the seat frame, and provide advantages in seat frames having a disassembly and reassembly of seat frame components.

Forms that are scaled, that are in size less lean, less narrow, broader, fuller, wanted for upholstered furniture, further the distribution of material in molding processes intrinsically descriptive of shell-structures. Forms that are contoured, that are in shape less rectangular, less sharp-edged, more rounded, blunter of edge, preferably generously contoured, wanted for upholstered furniture; significantly improve the distribution of material, and facilitate the pulling of finished parts from molds, in molding processes intrinsically descriptive of shell-structures.

Shell-structure molded seat frames have been made for over 50 years. They have been produced with a range of molding processes, and in a range of materials. The role of shell-structure molded seat frames in the furniture industry has however always been a modest one. As the capabilities of molded seat frames have been only modestly realized, so too have the capabilities of shell-structure molded seat frames. The advantages shell-structure molded seat frames provide for use in upholstered furniture has not been significantly recognized. Very few shell-structure molded seat frames outside of office chairs have been upholstered. No upholstered shell-structure molded seat frames of the likes of traditional upholstered sofas, loveseats and chairs, it is believed, have achieved significant commercial success.

Previous shell-structure molded seat frames particularly suffer these limitations:

Previous shell-structure molded seat frames do not make as effective a use as is possible of shell-structure strength in assuming compressive loading on the seat frame. This limits the breadth of spans shell-structure molded seat frames are capable of traversing, and the loads they are capable of assuming, without undue excess of material, and limits the range of designs and uses available to them. The durability or life-span of shell-structure molded seat frames is reduced because of the ineffective use made of shell-structure strength in assuming compressive loading, and/or inordinate strains being placed on a portion of the seat frame. The materials being available for use in shell-structure molded seat frames is diminished, especially for materials likely to be incapable of accepting the strains of an inefficient assumption of bending loading, such as paper or paper/fiber composites.

Previous shell-structure molded seat frames are not exceptionally well-suited for use in upholstered furniture. Previous shell-structure molded seat frames usually do not provide recessed or open area within the seat portion of the seat frame such as might accommodate a suspension. Previous shell-structure molded seat frames do not accommodate a suspension comprised of a fabric material which can wrap around all sides of the seat portion of the seat frame, giving firm support to the fabric material suspension, and distributing strain evenly across the seat frame. Previous shell-structure molded seat frames do not provide multiple options for upholstering.

Previous shell-structure molded seat frames provide less than optimal opportunities for assembly and disassembly of the seat frame. Limited opportunities for assembly and disassembly reduce the molding processes available for the seat frame's manufacture and may decrease the range of materials available to it. Limited opportunities for assembly and disassembly decrease the options available in the packaging and transport of the seat frame. Limited opportunities for assembly and disassembly decrease options for an interchanging of parts or sections of the seat frame. Movable parts or sections are not readily incorporated in previous shell-structure molded seat frames.

Previous shell-structure molded seat frames do not have the advantage of the light weight and efficient material use of space-frames for carrying compressive loads, nor join the advantages of the light weight and efficient material use of space-frames for carrying compressive loads with the efficiency of shell-structures for resisting shear and torsion. Previous shell-structure molded seat frames do not define a space-frame being scaled and contoured to enhance the properties of the seat frame for use in upholstered furniture while also providing a seat frame having exceptional structural integration and torsional strength. Previous shell-structure molded seat frames do not have the added design and engineering flexibility provided by space-frames for selectively positioned structural members. Previous shell-structure molded seat frames do not have the added design and engineering flexibility of structural strength in individual structural members being selectively described.

The present invention includes the recognition of problems found in the previous devices. The present invention includes the recognition of problems in seat frames of conventional construction, advantages in seat frames being of a molded construction, advantages in seat frames of a molded construction being shell-structure molded seat frames, and the recognition of problems in previous shell-structure molded seat frames.

According to an aspect of the present invention, the furniture is provided with a weight-bearing frame largely comprised of one or more molded components, where the molded components are largely shell-structure, and where a lattice form is defined by the molded components around a recessed or open area within the seat portion of the seat frame. Preferably, the lattice form defined has the character of a skeletal framework. Preferably, the molded components are scaled and contoured. Preferably, scaling and contouring provides substantial structural integration and torsional strength in the structure defined by the molded components. Preferably, the lattice form defines a lattice structure. A lattice structure differs from a lattice form in that a lattice form may be a representation of the form or a less than fully integrated structural unit, while a lattice structure necessarily functions as a significantly integrated structural unit. Preferably, the lattice form defines a lattice structure in the form of a space-frame. Preferably, substantially all of the weight-bearing portions of the frame are molded components.

In some embodiments, the furniture is upholstered. Preferably the upholstery and/or foam or padding and/or suspension is made of elements which can be readily put together and taken apart, e.g. by the user, preferably such that the user can readily substantially alter the appearance and/or feel of the furniture by "dressing" the same frame in different upholstering units. Preferably upholstery and/or suspension materials define space in and around the frame in varied ways, with a plurality of formats of "dress," with upholstery and/or suspension materials spanning or encircling parts of the frame, and the like. In one embodiment, in coupling to the frame, upholstery and/or foam or padding and/or suspension pass through an opening defined in the inner region of the frame.

FIG. 12A-1 is a detail view of region 12A-1 of FIG. 12A.

Figure 1A:
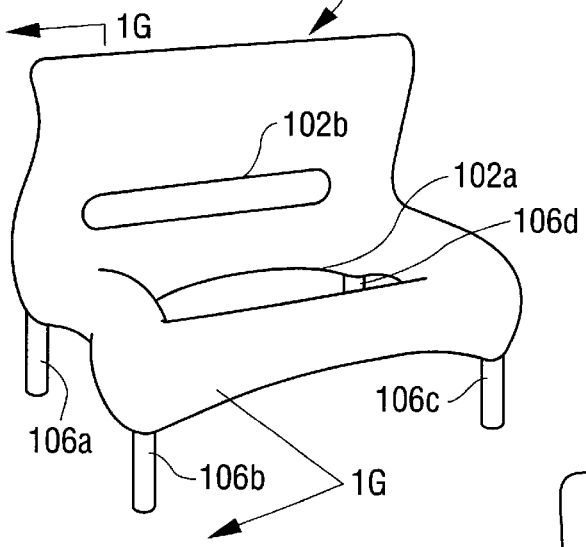
FIGS. 1A through 1F are perspective views of furniture frames according to embodiments of the present invention.
Figure 1B:
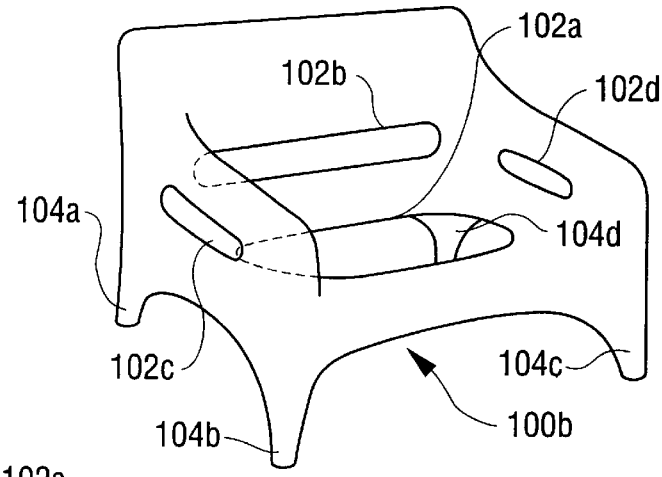
Figure 1C:
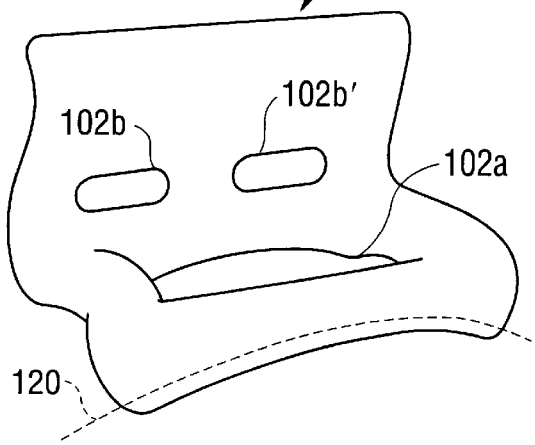
Figure 1D:
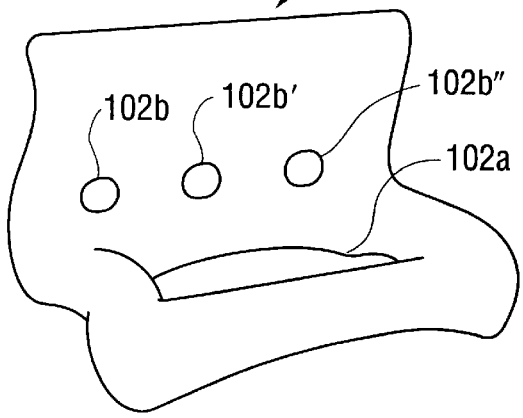
Figure 1E:
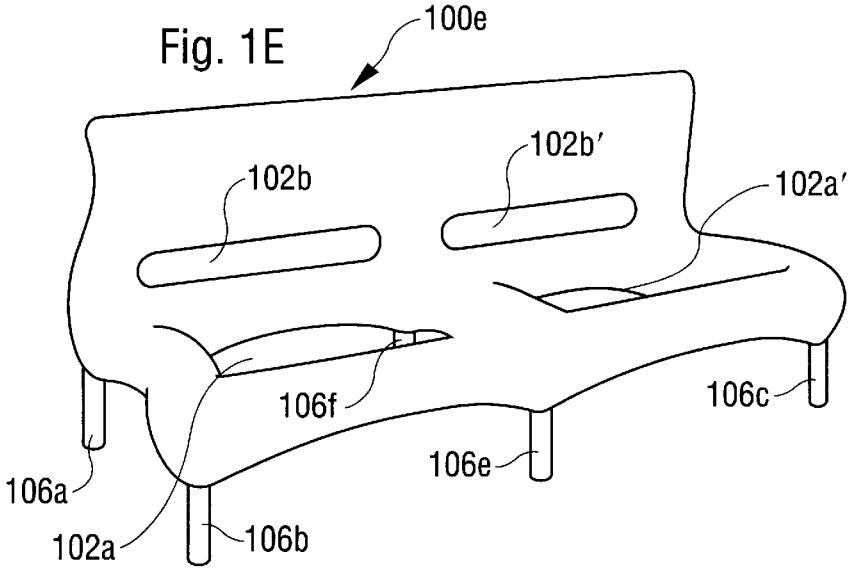

To facilitate an understanding of the present invention, it is useful to provide familiarity with a number of terms used herein.

As used herein, a seat or seating includes both single person seating and multi-person seating (e.g. as in a sofa, couch, loveseat or divan), and is preferably sized and configured to accommodate adults. The seats may be static or movable (such as being reconfigurable, reclining and the like).

As used herein, furniture frame or seat frame refers to the (typically three-dimensional) structural or weight-bearing or load-bearing component or components of furniture, by which the weight of the user is transferred to the legs and/or floor or other support surface. Typically, the frame defines one or more spans (i.e. regions which support a user's weight but which do not directly vertically overlie a leg or directly extend to the floor or other support surface). In use, the user may directly contact and rest on the frame surfaces, or the weight of the user may be transferred to the frame by suspension devices or materials, or coverings such as upholstery, which may include, e.g., fabric, padding, foam and the like.

As used herein, molding refers to a fabrication process in which a malleable material contacts and takes its shape from a defined and moldable form, e.g., a mold. The form defines surface area and, usually volume.

As used herein, molded seat frame refers to a seat frame in which the larger part (i.e., at least 50%) of the seat frame is comprised of a molded article or molded articles.

As used herein, shell-structure refers to an article describing a three-dimensional form, in which the larger part of strength within the article is strength of material concentrated to the outer surface area of the three-dimensional form joined to strength of structural shape in the outer surface area of the three-dimensional form. Examples of shell-structures in nature include mollusk shells, egg shells and exoskeletons. The shell-structure may be either a closed shell construction, in which a cross-section through the shell defines a closed curve (e.g. as depicted for the components in FIG. 7C), or an open shell construction, in which a cross-section defines an open curve, such as a U-shape (e.g., as illustrated in FIGS. 8A through 8D). In many instances, closed shell construction provides structural strength advantages. However, open shell construction can have its structural strength characteristics enhanced by a number of techniques, including reinforcement of edges with added strength of material (enhanced material distribution), reinforcement of edges with added strength of structural shape (e.g. with turned-inward or turned-outward edges), reinforcement between edges or on or between inner surfaces, and increased depth.

As used herein, shell-structure molded seat frame refers to a seat frame in which the larger part (i.e., at least 50%) is comprised of a molded article or molded articles, in which the larger part (i.e., at least 50%) of the molded article or molded articles is shell-structure.

As used herein, molding processes intrinsically descriptive of shell-structures refers to molding processes that by their nature are inclined to produce shell-structures. In molding processes intrinsically descriptive of shell-structures, the molded malleable material, in contacting and taking its shape from the defined form, tends to travel or migrate in volumes that are broad rather than volumes that are narrow, tends to travel at and onto the outer surface area rather than through the volume, and tends to concentrate to the outer surface area rather than elsewhere. Examples of such molding processes are stamping, thermoforming (and variants thereof), twin-sheet thermoforming, blow-molding, spray-molding, dip-molding, rotational molding, and foam-molding with broader volumes and material concentrated to the outer surface area. Distributed multiple-head injection-molding and distributed multiple-head reaction injection-molding may also, in some circumstances, intrinsically define shell-structures.

As used herein, lattice structure refers to a structure defining a lattice form, being comprised of structural elements or structural members that together function as an integrated structural unit. The primary structural strength in a lattice structure is in, and between, the structural elements or members. The structural strength of the structural elements or members in a lattice structure are in relative balance one with another. Preferably the structural strength of the structural elements or members are in relative balance one with another such that no given structural element or member, during normal use, bears substantially more or less load, on average, than other structural elements or members and, preferably, stress or load is, on average, in normal use, distributed substantially equally among structural elements or members (e.g., such that in normal use, average stress on any given structural element or member is within about 35%, preferably within about 25%, more preferably within about 15% and even more preferably within about 5% of the normal use average stress on any other structural element or member).

As used herein, space-frame refers to a lattice structure having the character of a skeletal framework.

As used herein, skeletal framework refers to a bone-like framework.

Figure 8A:
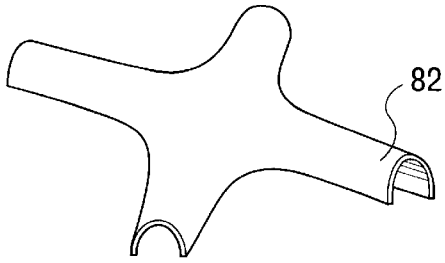
FIGS. 8A through 8D are perspective conceptual views of shell components.
Figure 8B:
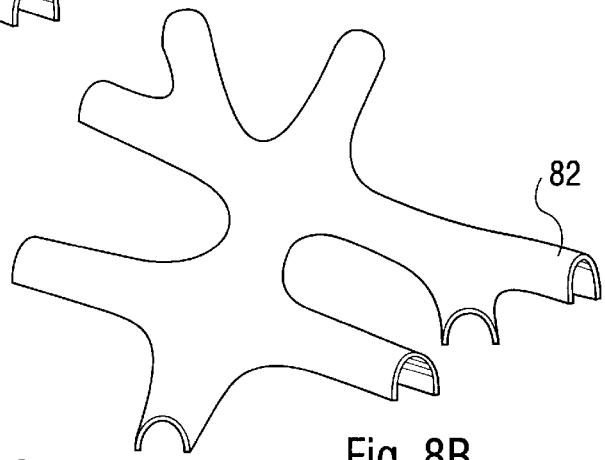
Figure 8C:
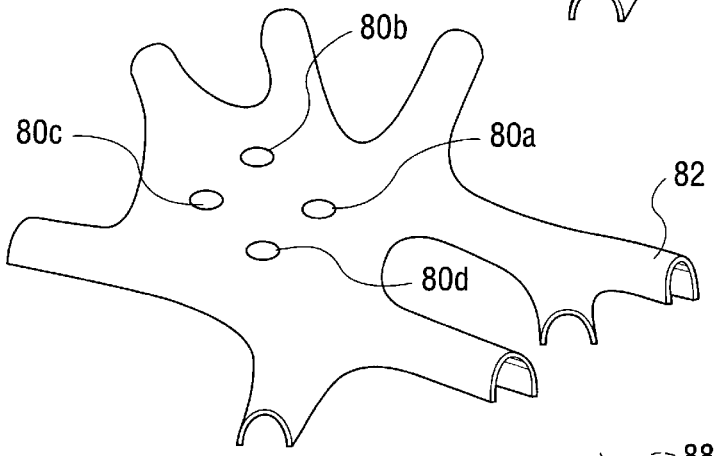
Figure 8D:
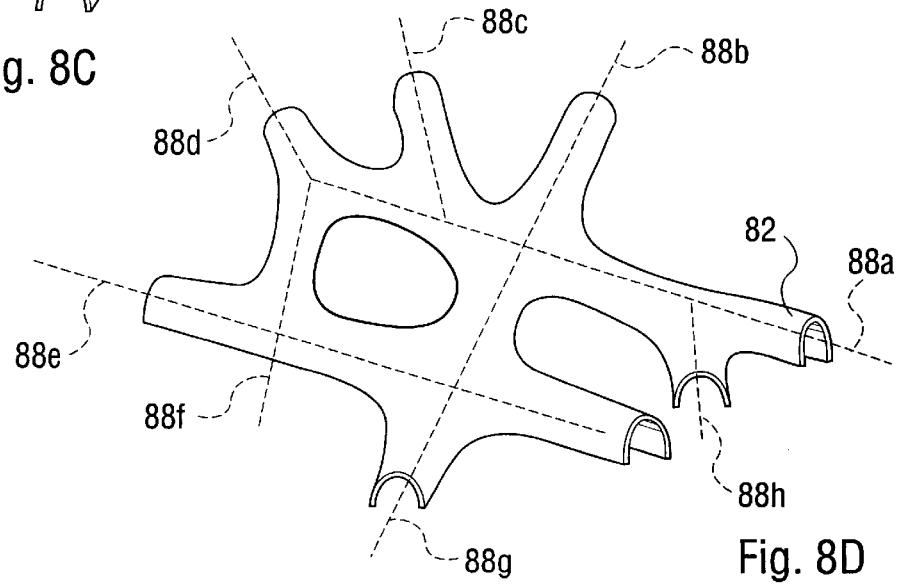

In FIG. 8A a shell-structure is depicted (it is open shell construction). FIG. 8A depicts an article describing a three-dimensional form 82, in which the larger part of strength within the article is strength of material concentrated to the outer surface area of the three-dimensional form joined to strength of structural shape in the outer surface area of the three-dimensional form (its convex shape). The structural shape of the shell-structure depicted in FIG. 8A is an effective structural shape. The orientation of the shell-structure (downward facing) depicted in FIG. 8A is effective for compressive loads, and provides the surface area appropriate for use in furniture. FIG. 8B depicts the shell-structure of FIG. 8A as it might extend across space, e.g. to span a distance. FIG. 8C demonstrates that the shellstructures of FIGS. 8A and 8B, to perpetuate across space, particularly a broader and/or wider space, e.g. to span a distance, particularly a broader and/or wider distance, in an ultimately effective manner, preferably defines a lattice form (in FIG. 8C a series of lattice forms are defined, having plurality of openings 80*a* through 80*d*). In FIG. 8C the series of lattice forms defined, having plurality of openings 80*a* through 80*d*, define a series of lattice structures having plurality of openings 80*a* through 80*d*. FIG. 8D depicts a shell-structure having characteristics of the shell-structures of FIGS. 8A through 8C, defining a lattice form having the character of a skeletal framework. In FIG. 8D the shell-structure having characteristics of the shell-structures of FIGS. 8A through 8C, and defining a lattice form having the character of a skeletal framework, 88*a,b,c,d,e,f,g,h* defines a lattice structure in the form of a space-frame.

As used herein, a scaled frame refers to a frame in which the exterior surfaces are relatively wide and/or broad, particularly such as to make the frame especially well-suited for use in upholstered furniture, i.e., such that the upper, front portion of the frame is greater than about 2 inches (about 5 centimeters) preferably greater than about 3 inches (about 7.5 centimeters) and more preferably greater than about 4 inches (about 10 centimeters).

As used herein, a contoured frame refers to a frame in which the exterior surfaces provide a relatively smoothly shaped surface, particularly such as to make the frame especially well-suited for use in upholstered furniture, i.e., substantially without sharp angles, i.e., such that the smallest radius of curvature defined by the cross-section is greater than about 0.5 inches (about 1.2 centimeters), preferably greater than about 0.75 inches (about 2 centimeters), more preferably greater than about 1 inch (about 2.5 centimeters), and most preferably greater than about 1.5 inches (about 4 centimeters). A frame or frame component is generously contoured if no region of the surface of the upper portion of the frame defines, in cross-section, a radius of curvature less than about 1 inch (about 2.5 centimeters).

Structural integration refers to the character and degree of integration of structural strength in a structure. A structure with substantial structural integration is a structure having high integration of structural strength, low or minimized stress raisers, high or maximized stress distribution, and preferably high torsional strength, between the various elements in, or component parts of, the structure. A structure with substantial structural integration might be an optimized structure, i.e. a structure in which maximum strength is achieved using minimum material. A structure with substantial structural integration may also be an efficient structure, i.e. a structure in which the dimensionless ratio of strength to mass is at least 80%, preferably at least 90%.

FIGS. 1A through 1D depict single-seat furniture frames according to embodiments of the present invention. The embodiments of FIGS. 1A through 1F depict shell-structures as can be seen, e.g., from the cross-sectional view of FIG. 1G. In the embodiments of FIGS. 1A through 1F, substantially all load bearing components of the frame are shell-structures. The frames of FIGS. 1A through 1F define openings 102*a*, 102*a'*, 102*b*, 102*b'*, 102*b"*, 102*c*, 102*d*, 102*f*, 102*g*. The embodiments of FIGS. 1B and 1F have legs 104*a, b, c, d*, which are part of the frame itself while the embodiments of FIGS. 1A, 1C, 1D, and 1E are configured to receive separate, non-integral legs, as illustrated by legs 106*a–f*, coupled to the frame 100*a–f*, e.g., by a coupling such as a screw coupling, friction coupling, bolt and nut coupling, latch coupling, wedge coupling and the like, e.g. by receiving a leg component in sockets 108*a*, 108*b*(FIG. 1G) formed in or coupled to the frame 100.

As another example of a method and apparatus for connecting legs, it is possible to use a structure similar to the common metal vegetable steamer/strainer used in pots of varying sizes to steam vegetables, such as those with sides that overlap and collapse inwards. In this embodiment, such a structure may be coupled to the frame by inserting backwards through a hole in the frame at the area where the leg is to be located. The hole may have a diameter of, e.g. about one inch (about 2.5 centimeters). The device is then pulled back so as to expand and become fixed structurally. The leg piece, with regular metal threads, is screwed through a receiving threaded, reinforced part in the structure. The leg piece itself can have a screw fixed in it or joined to it during the user's assembly of the frame.

Figure 2A:
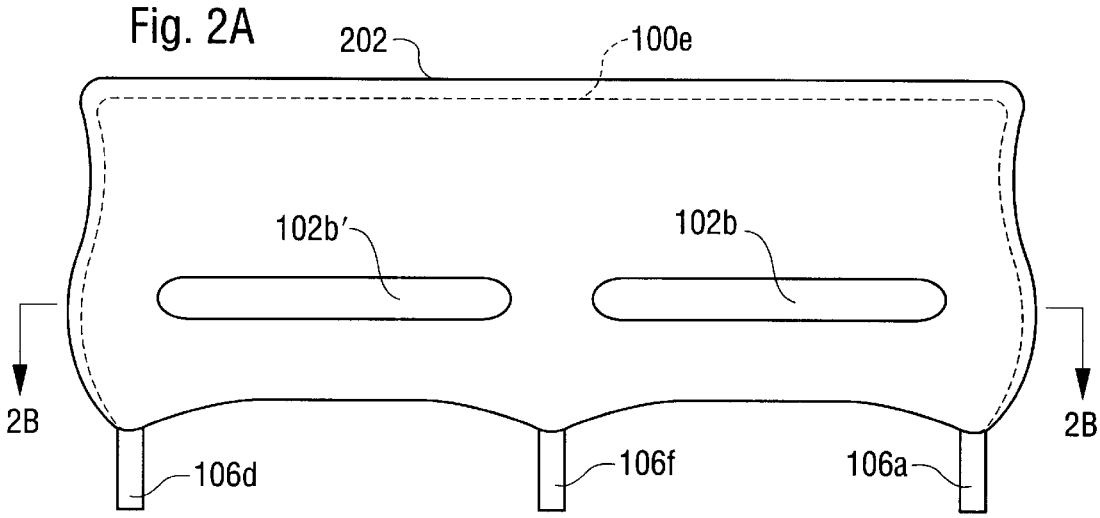
FIG. 2A is a rear elevational view of upholstered furniture according to one embodiment of the present invention.
Figure 2B:
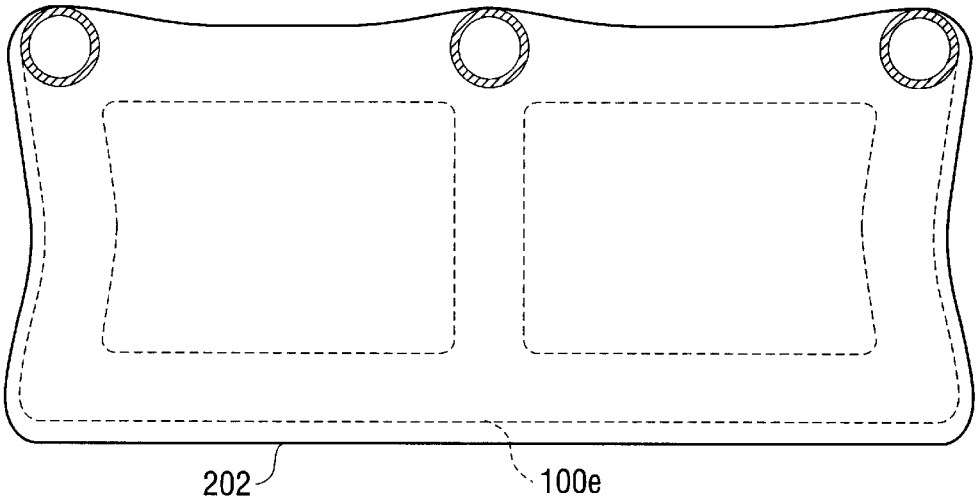
FIG. 2B is a cross-sectional view taken along the line 2B—2B of FIG. 2A.
Figure 2C:
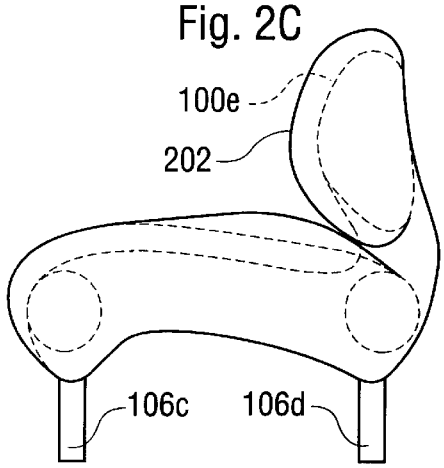
FIG. 2C is an end elevational of the embodiment of FIG. 2A.

FIGS. 2A through 2C depict an upholstered couch. It is covered with padding and/or foam and/or fabric 202, e.g., by materials and methods described more fully below.

Frames such as depicted in FIGS. 1A through 1F can be formed using a number of methods and materials. Preferably, the frame and/or frame components are made using a molding process. Preferably, the molding process is a molding process which is intrinsically descriptive of shell-structures. Being a fabrication process in which a malleable material contacts and takes its shape from a defined and moldable form, molding can be as simple as a foam poured into a tray and setting, or as exotic as a structure grown in a form (e.g., crystals), or biological materials or organisms grown in a form (e.g., as might grow, die, and leave in their wake a structure).

The frame can be made by methods other than molding such as carving or grinding, or laser-cutting. Laser sintering can possibly by used. The materials processed by these means might be foamed articles, with reinforcement later affixed on outer surfaces (or spray-molded onto the article). In a laser cutting or a laser sintering of a foamed article, a shell-structure may be formed in reaction to the laser, e.g., by a chemical reaction in the material, or by a melting of the material. The frame also can be made through an extrusion process where the extruding head is movable and directable and so may progressively define the frame, analogous to frosting material squeezed through a tube onto a cake, or toothpaste decoratively squeezed across a surface. The size and/or shape of the extruding head can vary, as can the properties of the material composition (as through a selective foaming of material within the extruding head, or as through the threading of reinforcing fibers through the extruding head). An extrusion process such as this can be used in conjunction with molds. Computer-driven tools are applicable for all of the above processes described.

Frames such as depicted in FIGS. 1A through 1F can be formed using a wide range of materials. Preferably the frame and/or frame components are formed of a material such as steel, glass, paper or paper/fiber composite, and the like (i.e., commodity materials that are readily recyclable and relatively fire-safe). Plastics both thermoset and thermoplastic can be used, including fiber-reinforced composite constructions such as fiberglass and other composite constructions. For plastics, commodity thermoplastics such as polyethylene and polypropylene are preferred, and may be undyed. Fiber-reinforced composite constructions and other composite constructions can also be produced using materials other than plastics. Material distribution within the molded articles may be "taffy-like." Material distribution within the molded articles may be an engineered foam composition. Material distribution within the molded articles may incorporate areas of varied material density. The shell-structure may have a double-walled construction. Other materials can be used such as various metals, sheets of mesh of aluminum or steel, super-plastic steel, ceramic, ceramic metal, ceramic foam, resin impregnated paper or wood fiber, or bonded fibers of other materials such as glass, and the like.

With the capabilities of molding a wide variety of properties, structural and otherwise, can be engineered into the seat frame and the materials comprising it. Variations in rigidity and elasticity can be engineered into the frame through the shape of the shell-structure (e.g., with pleating-like, gently contoured forms) or its material composition (e.g., with material selectively removed as through strategically placed holes, with material distribution selectively enhanced, with variations in material density within the shell-structure forms, or with selectively distributed reinforcement fibers). The properties of foam/padding may be engineered directly into the seat frame in a rotational molding process by entering into the mold in stages materials of varying density during the molding process. It is also possible that properties of foam/padding can be configured directly in the seat frame using an engineered foam material composition having areas of varied material density. The seat frame readily accommodates ergonomic and/or therapeutic features such as lumbar support 110, incorporated as a part of the frame itself. The spatial variation and stress distribution arising from a mid-span depth increase 112, as depicted in FIG. 1F and/or mid-span concavity 114.

FIGS. 10A through 10N, 11A through 11N and 12A through 12J illustrate various constructions of shell-structures 1001*a*–1001*n*, 1101*a*–1101*n*, 1201*a*–1201*j*. These illustrations are based on the molding process of stamping, particularly such as using a high-tensile strength steel, but the principles of the illustrated shell-structure constructions apply to other molding processes as well.

Figure 10A:
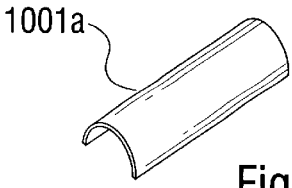
FIGS. 10A through 10N, 11A through 11N and 12A through 12J depict shell-structures, according to an embodiments of the present invention.
Figure 10B:
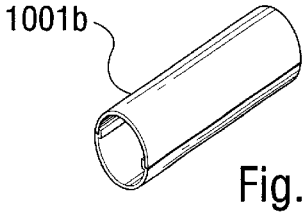
Figure 10C:
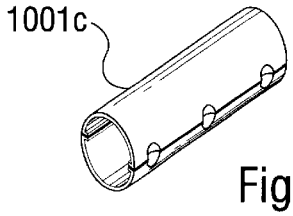

FIG. 10A shows a basic stamped shell-structure article. FIGS. 10B and 10C show two ways of joining basic stamped shell-structure articles.

Figure 10D:
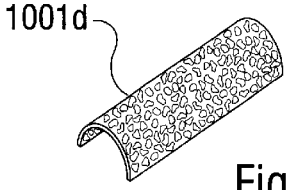

FIG. 10D depicts a shell-structure given decorative treatment. In this illustration, material is removed from the steel sheet and forms a decorative pattern. For example, the pattern might be characteristic of a metal Persian screen. Such patterning can also be etched into the material or stamped into it. The steel article can be painted including enameling of the steel.

Figure 10E:
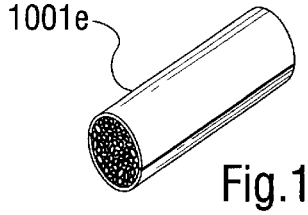

FIG. 10E illustrates a shell-structure which is internally foamed.

Figure 10F:
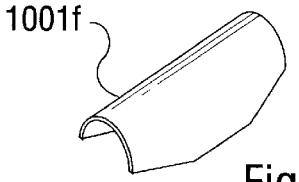

FIG. 10F depicts a shell-structure in which the depth of the shell-structure is increased in the center of the span.

Figure 10G:
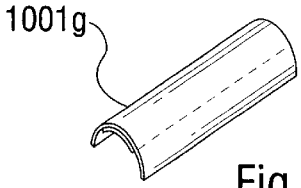

FIG. 10G depicts an embodiment in which material is added so as to reinforce the top. In stamping in a slush-molding, this can also be added to the material as it is molded.

Figure 10H:
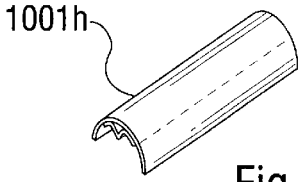
Figure 10I:
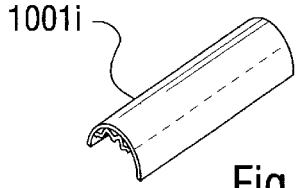

FIGS. 10H and 10I depict an embodiment in which strength through structural shape is added so as to reinforce the top.

Figure 10J:
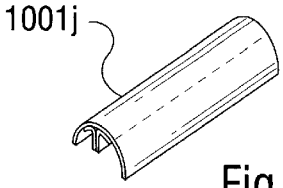

FIG. 10J depicts an embodiment in which a structural member is incorporated but the molded article remains a shell-structure.

Figure 10K:
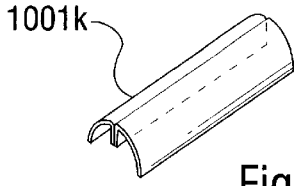

FIG. 10K depicts a device in which two pieces are joined. It would also be possible to provide a device in which three or more pieces are joined.

Figure 10L:
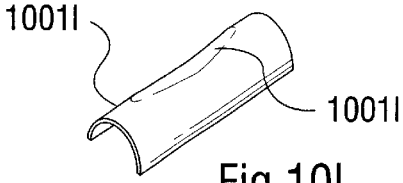

FIG. 10L depicts a device with a molded-in recess 1002*l* providing strength through structural shape, along a portion of the top.

Figure 10M:
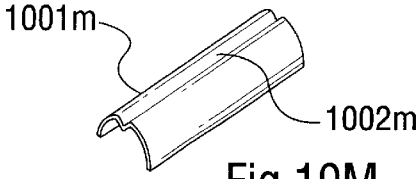

FIG. 10M depicts a device with a molded-in recess 1002*m* along the extent of the top providing strength through structural shape.

Figure 10N:
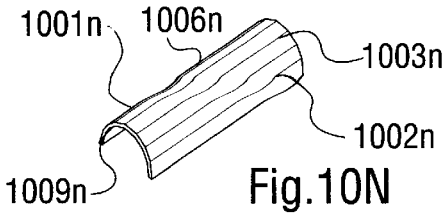

In the embodiment of FIG. 10N, sharp edges 1002*n*, 1003*n*, 1006*n*, 1009*n*, provide added strength in the part while the contoured shape is still substantially maintained.

Figure 11A:
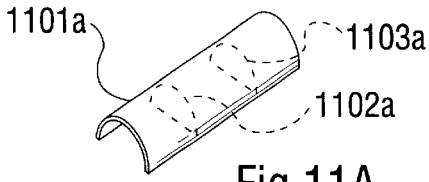

In the device of FIG. 11A structural elements 1002*a*, 1003*a* are incorporated across the shell-structure.

Figure 11B:
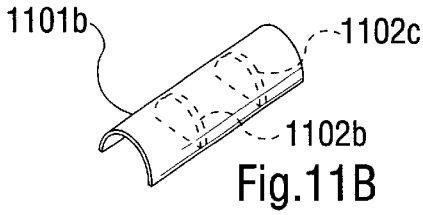

FIG. 11B depicts a device in which strength is enhanced through added material 1102*b*, 1102*c* achieved with structural elements added to the shell-structure reinforcing across the shell-structure. This is similar to the structural model represented by bamboo in which added material and added strength through structural shape also reinforce a shell-structure. A comparable structure can be achieved as molded-in, with rotational-molding, using foamed parts or web-like material inserted in the mold for the molding process and drawing a section of the rotational-molded material onto its surface.

Figure 11C:
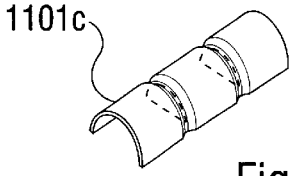

The structure in FIG. 11C shows strength enhanced through structural shape achieved with pieces added to the shell-structure, reinforcing across the shell-structure.

Figure 11D:
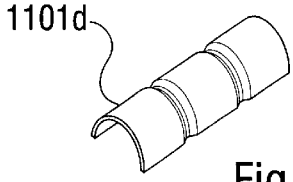

FIG. 11D depicts strength through structural shape molded-in, reinforcing across the shell-structure. A spiral, overlapping format for this construction can also be used. A spiral format may be particularly advantageous for creating an engineered-level of flexibility within the shell-structure frame.

Figure 11E:
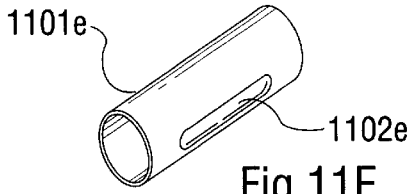

FIG. 11E depicts reinforcement along a portion of a side of the shell-structure through a shell's molded-in structural shape 1102*e*.

Figure 11F:
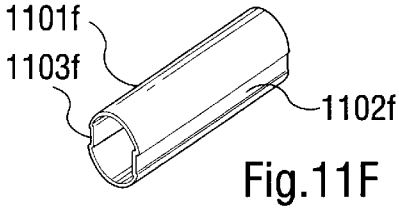

FIG. 11F depicts reinforcement along the length of the sides of the shell-structure through molded-in structural shape 1102*f*, 1103*f*.

Figure 11G:
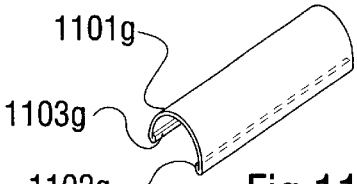

FIG. 11G depicts reinforcement along the bottom edge of an open shell construction shell-structure 1102*g*, 1103*g*. In this embodiment reinforcement is provided as a folding over of the lower edges to be used if molding processes permit.

Figure 11H:
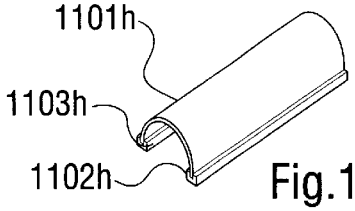

FIG. 11H depicts reinforcement along the bottom edge of an open shell construction shell-structure through an added piece 1102*h*, 1103*h*.

Figure 11I:
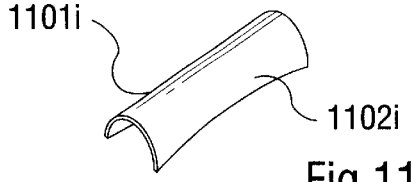

FIG. 11I depicts reinforcement of a bottom edge of a shell-structure by narrowing the shape of the shell-structure along its lower edge 1102*i*.

Figure 11J:
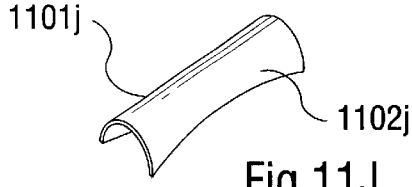

FIG. 11J depicts reinforcement of a shell-structure by narrowing overall sides in the center portion 1102*j*.

Figure 11K:
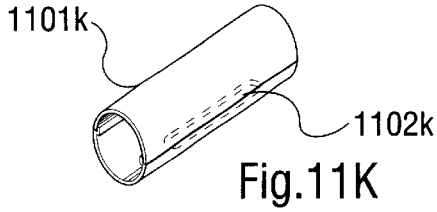

FIG. 11K depicts reinforcement along a portion of the bottom shell-structure through a molded-in structural shape 1102*k*.

Figure 11L:
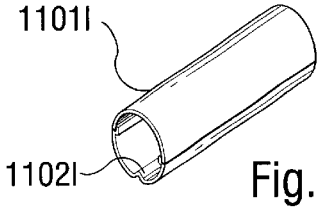

FIG. 11L depicts reinforcement along the length of the bottom shell-structure through a molded-in structural shape 1102*l*.

Figure 11M:
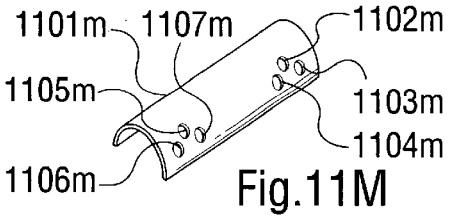
Figure 11N:
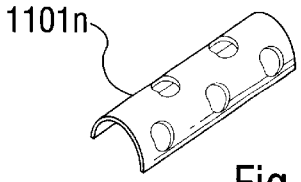

FIG. 11M depicts removal of material from the shell-structure 1102*m* through 1107*m*. FIG. 11N depicts removal of material from a shell-structure with a lattice structure being described through, within the shell-structure.

Figure 12A:
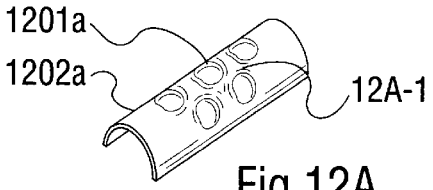
Figures 1, 12A:
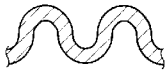

FIG. 12A depicts removal of material from a shell-structure (in this embodiment with a lattice structure being described through, within the shell-structure) with zigzagging, e.g. 1202*a*, between areas being used for creating an engineered degree of flexibility with the shell-structure frame.

Figure 12B:
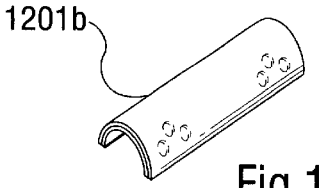

FIG. 12B depicts adding of a material to a shell-structure, e.g. providing two adjacent surfaces.

Figure 12C:
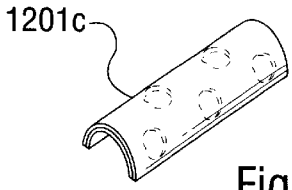

FIG. 12C depicts adding a material to a shell-structure with a lattice structure being described through, within the shell-structure.

Figure 12D:
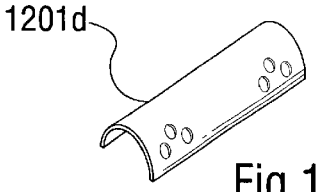

FIG. 12D depicts structural shape incorporated within the shell-structure.

Figure 12E:
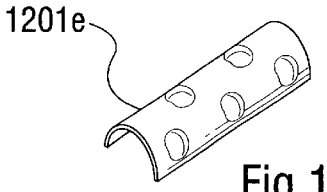

FIG. 12E depicts structural shape incorporated within the shell-structure with a lattice structure being described through, within the shell-structure.

Figure 12F:
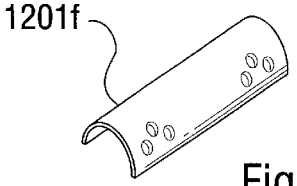

FIG. 12F depicts a particularly pronounced (with depth) structural shape within the shell-structure.

Figure 12G:
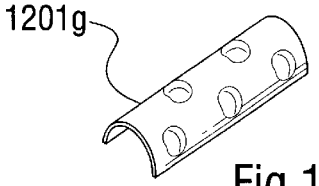

FIG. 12G depicts a particularly pronounced (with depth) structural shape within the shell-structure with a lattice structure being described through, within the shell-structure. A similar construction in nature can be seen in the structure of certain cacti, including, e.g., a prickly pear and/or cactus.

Figure 12H:
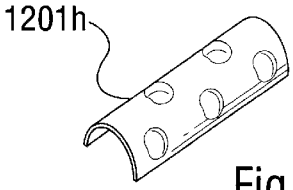

FIG. 12H depicts a structural shape within the shell-structure (here shown with lattice structure being described through, within the shell-structure), with depth of that structural shape within the shell-structure being varied, as for selective reinforcement of structural strength.

Figure 12I:
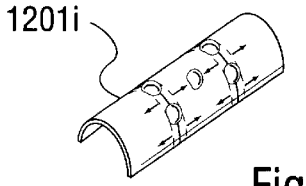

FIG. 12I depicts a particularly pronounced (with depth) structural shape within the shell-structure with that particularly pronounced (depth) structural shape as might be used for division and assembly of the shell-structure.

Figure 12J:
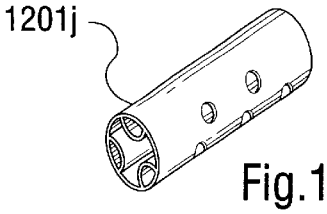

FIG. 12J depicts a molded structure within the shell-structure, with holes penetrating the surface, being particularly useful for use in passing strapping-like material through for control of motion elements and directing its travel. With rotational-molding this can be achieved using inflatable bags such as Teflon™ for such added structure within the shell. In rotational-molding, using such Teflon™ inflatable in the molding process, the holes penetrating the mold itself, through which Teflon™ bags pass, can be made large, with reinforcement added to the sidewalls of the Teflon™ bags, so that various variations in bag types or configurations of the frame can be enabled with a limited set of original molds.

Rotational molding is particularly useful for seat frames produced as a single integrated unit and is particularly apt for producing closed shell construction shell-structures. Rotational molding is a low-pressure molding process. Relatively lightweight, inexpensive molds can be used, particularly lightweight molds of stamped steel having strength mirroring that of the molded article. Rotational molding can readily incorporate inter-inflatable moldable forms, such as inflatable Teflon™ bags. Complex inter-inflatable moldable forms can be used to create complex joints (e.g. for movable joints), passageways for weaving strapping or similar materials through the forms (e.g. as for use in directing the travel of joints, and/or distributing stresses arising at joints throughout the larger article) and that might be analogous in ways in character to the character of a worm-eaten article, cavities or voids within the form that may in novel fashion accommodate therapeutic or comfort capabilities such as massage or pneumatic variable body support (or microwavable heated gel pads that might in occasional use be inserted within the form, such as in areas around the user's neck, shoulders, or lower back), and the like. Rotational molding provides for flexibility in engineering material composition, including selective distribution of material, variability of wall thickness, selective distribution of reinforcing fibers, selective foaming of material, and combinations of the same. Pressure (e.g. air pressure) may be incorporated between stages in the molding process, or after the final stage of the molding process, so as to increase density in the molded materials. Calibrated valves may be used to create a measured increase in pressure within the mold, and on the materials inside the mold.

Another forming process useful in connection with the present invention is stamping, particularly using high-tensile steel. Using this process, thin forms of great strength can be made. The thin forms are excellent for seat frames having disassemblable and reassemblable component parts, and disassembled component parts can be shaped so as to optimally internest for compact shipping. Disassemblable or component parts are in fact preferable for use with this forming process because the smaller size of the forms means smaller presses can be used.

In another stamping process, shapes can be formed using a slush-like mass of material (instead of, e.g., a sheet material), in a process not unlike compression or transfer molding, and referred to herein as slush-molding. This process can be used in connection with, e.g., paper or paper/fiber composites or wood fiber composites, wherein stamping can create the relatively high density in these materials preferable for their use in furniture. The volume of material can be selectively distributed, and reinforcing fibers selectively positioned. A net-like integrated mesh of fiber reinforcement can be incorporated to provide security for the molded construction at the end of its useful life (i.e. such that the molded seat frame may give way, rather than collapse, at the end of its useful life).

Another forming option is foam-molding, which is a relatively low-pressure process. In some embodiments, the form, or portions thereof, may be an inflatable article. In one embodiment, the inflatable mold and molding material can be compactly packaged and transported and may be moldable directly by the end user in some instances.

In another embodiment, the form can be provided by a process of spraying material, such as fiberglass, against a mold, or onto an article such as a lightweight, foamed, pre-molded article, hereinafter called spray-molding. In one embodiment, a chopper gun cuts a continuous strand of fiber material into small pieces, which join with a spray of resin, and is sprayed against a mold. Precise and sophisticated control of spray-molding can be achieved using, e.g., computer control in a fashion analogous to ink-jet printers to provide highly-controllable spatial variation of the molded form. In one embodiment, glass fiber and/or molten glass in fibrous form is sprayed against a mold or onto an article.

The lattice form defined by the seat frame may be a plural lattice form, i.e., having a plurality of openings 102*a*, 102*a'*, 102*f*, 102*g*.

Figure 1F:
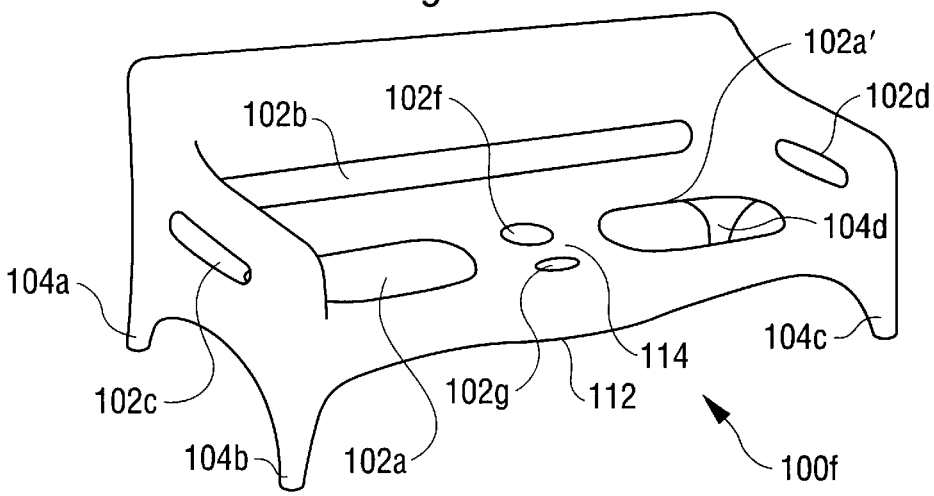
Figure 1G:
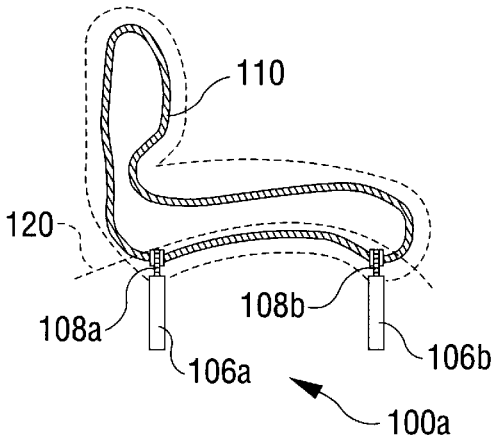
FIG. 1G is a cross-sectional view taken along the line 1G—1G of FIG.1A.
Figure 3A:
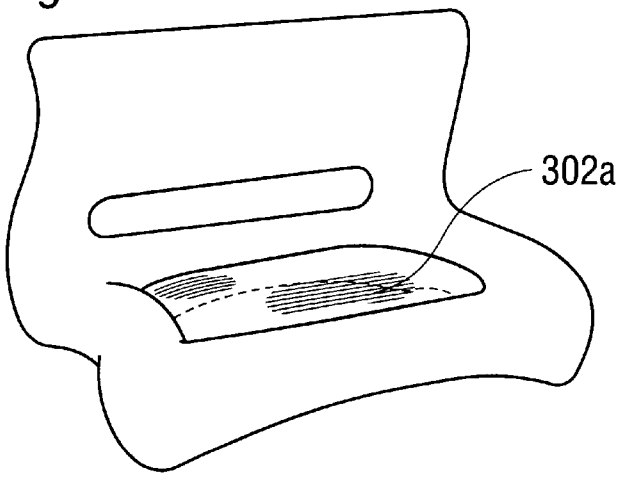
FIGS. 3A through 3C are perspective views of seat frames according to embodiments of the present invention.
Figure 3B:
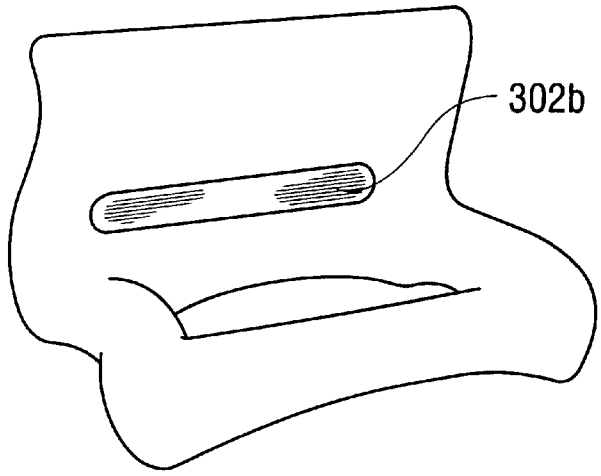
Figure 3C:
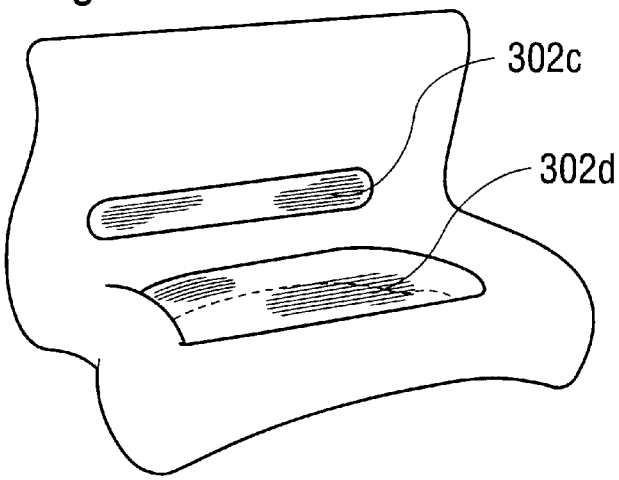

The embodiment of FIG. 1A shows an "openwork" configuration, with the area surrounding the lattice form being open, in contrast to the embodiments of FIGS. 3A through 3C. The openwork seat frame is preferable for some molding processes. It is advantageous in assembly and disassembly of the seat frame, enhancing options for packaging and transport, interchangability of parts or sections of the seat frame and the like. It is preferable in application of the fabric material for suspension and it is preferable for upholstering of the seat frame, as described more thoroughly below.

Figure 7A:
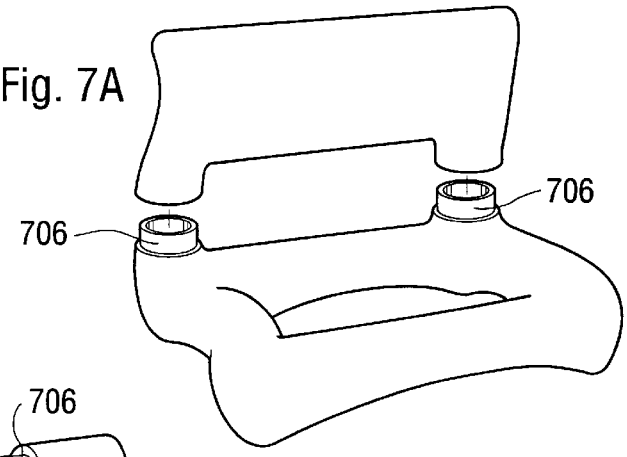
FIGS. 7A through 7F are perspective exploded views of frame components according to aspects of the present invent.
Figure 7B:
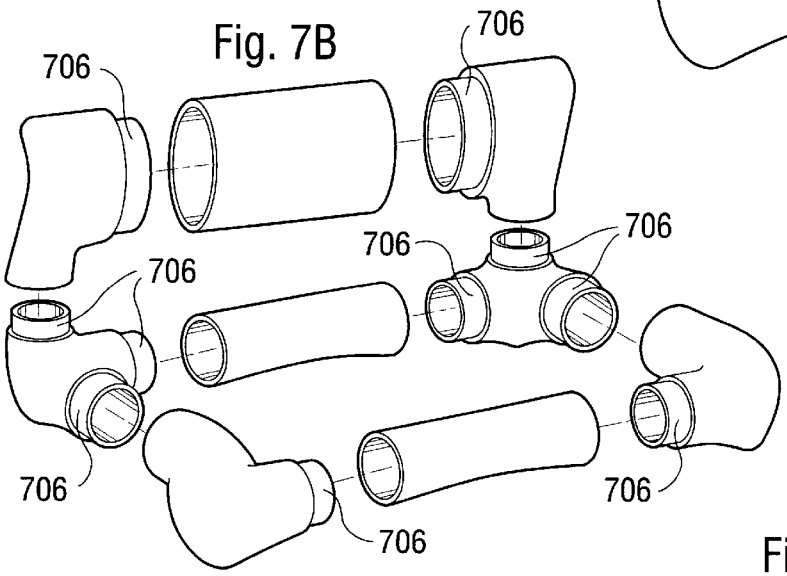
Figure 7C:
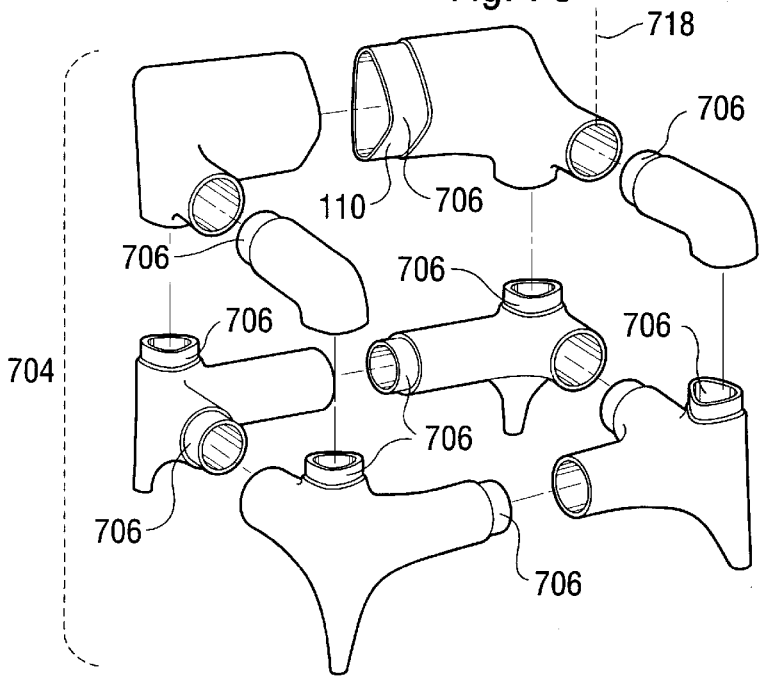
Figure 7D:
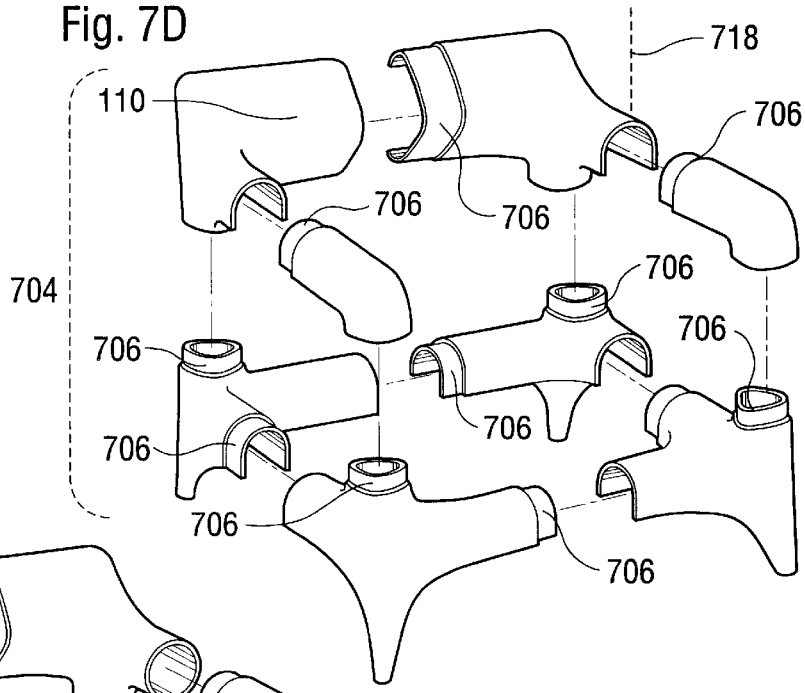
Figure 7E:
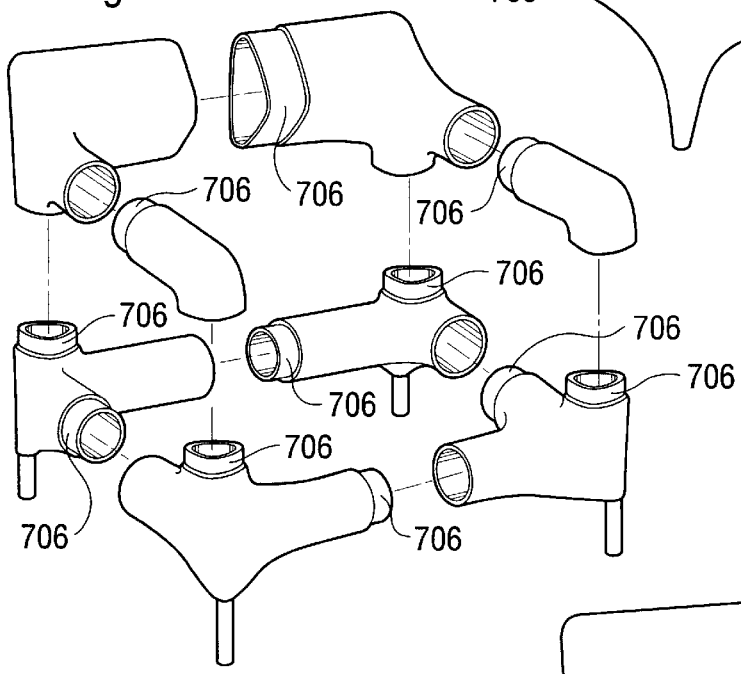
Figure 7F:
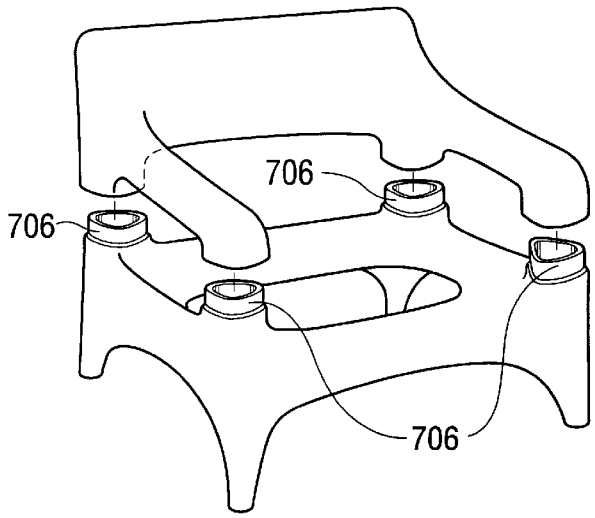

FIGS. 7B and 7D, respectively, illustrate closed shell construction and open shell construction shell-structures. The closed shell construction shell-structure seat frame is preferable for some molding processes. It is advantageous in assembly and disassembly of the seat frame, enhancing options for packaging and transport, interchangability of parts or sections of the seat frame, etc. It is advantageous for embodiments which are upholstered. It can increase the loading strength of the shell-structure elements or members forming the seat frame, and can enhance the overall structural integration and torsional strength of the seat frame.

As depicted in FIGS. 7A through 7E, the frame, rather than being substantially integral as depicted in FIGS. 1A through 1F, can be provided in two or more parts 704 which may be coupled together. Preferably, the coupling mechanism is substantially integral with the frame members such as by friction fitting of collars 706 into corresponding sockets formed in adjacent sections. To enhance security of coupling, the coupled devices may be further secured by ribbing or other friction-enhancing surfaces, or by couplers such as screws, nuts and bolts, snap fasteners or snap-in fittings, living hinges, and the like. Where a limited cross-sectional area is available, the given cross-sectional area of the frame available for joining the forms may be increased by multiplying the forms within the given area of the frame such as by scalloping or other convolution.

In some configurations, the shell-structure is not radially symmetrical such that there is an axis of depth or elongation 718 (FIGS. 7C and 7D) wherein the shell-structure, in cross-section, is deeper (having greater depth in the vertical dimension) than it is wide (i.e., extent in horizontal direction). Vertical orientation of the depth can enhance strength for assuming bending loading from the (typical) vertical load of a user. In the depicted embodiment, the shell-structures are typically arched 120 (FIGS. 1C and 1G), which may enhance loading strength, and are in general shaped so as to better transfer loads to legs 106 or other points of distribution so as to provide for more even distribution of load and/or stress. In one embodiment, by providing a frame which is more easily designed and fabricated, such as by molding, the frame can be custom fit to a user, i.e., specially designed and manufactured to conform more closely to the characteristics of the body of a particular user.

In one embodiment, the frame is designed and constructed to provide a controlled degree of flexibility, rather than being substantially rigid, such as through variations in shape within the shell-structure forms, or through variations in the material composition of the shell-structure, e.g., strategically placed holes or otherwise selectively distributed material, selectively distributed reinforcing fibers and the like. It is believed that providing a measured degree of flexibility within the frame may enhance its usefulness by absorbing and distributing stress, such as in absorbing the momentum or impact of an individual sitting down on the frame.

Figure 6A:
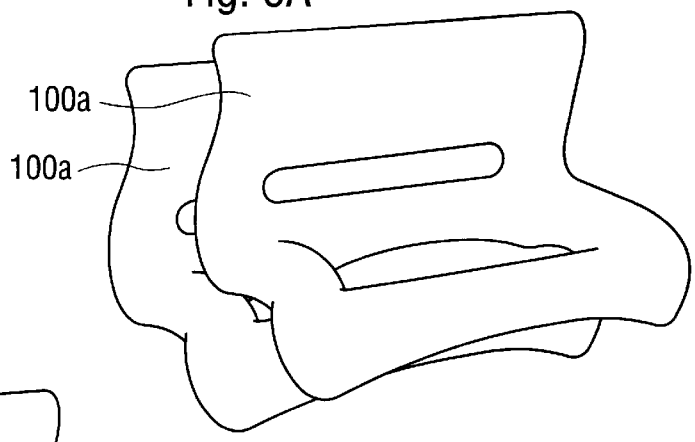
FIGS. 6A through 6D are perspective exploded views of frame components according to embodiments of the present invention.
Figure 6B:
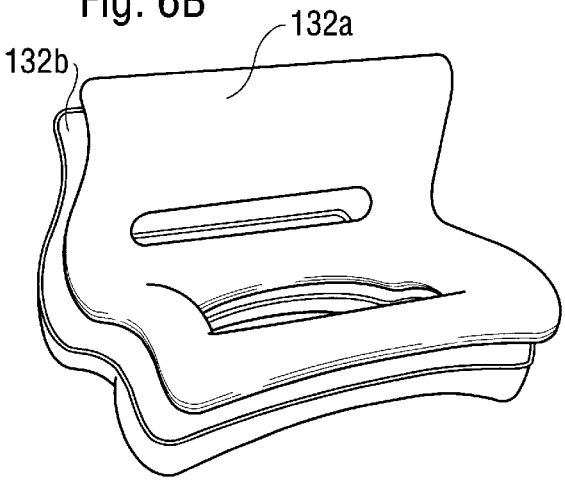
Figure 6C:
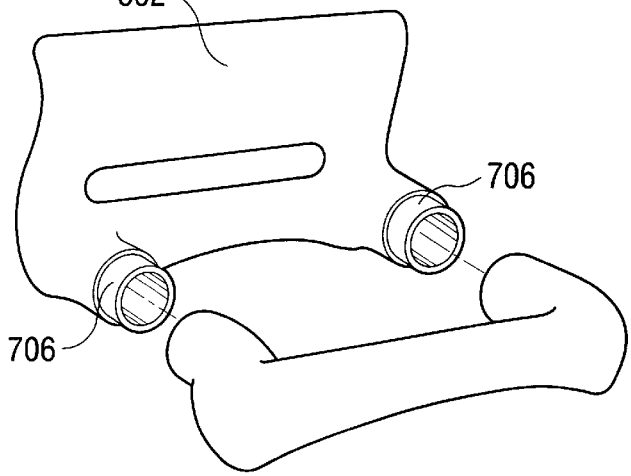
Figure 6D:
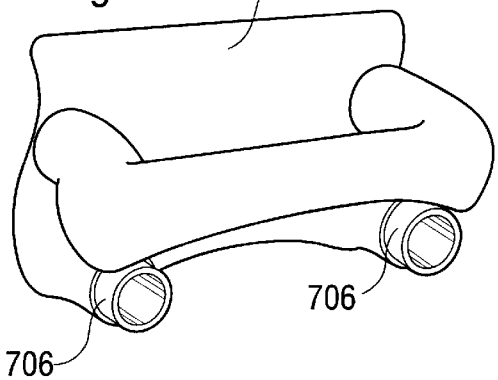

In one embodiment, seat frames 100*a* are configured to easily and, preferably, efficiently, internest and/or stack (as depicted in FIG. 6A) e.g., to facilitate transportation and/or storage. In one embodiment, the shell can be disassembled into two or more parts along a side seam to define upper and lower halves 132*a*, 132*b* which are, preferably, stackable and/or internestable, or as depicted in FIGS. 7A through 7F, 6E and 6D, e.g., for ease of transportation and/or storage. In disassembling a seat frame, disassembly can be both along side seams and across sections. FIG. 6D depicts, e.g., internesting. Preferably, the frame can be disassembled and/or stacked and/or internested (as a whole, or component-wise) by the end-user, such as using the coupling configuration depicted in FIGS. 7A through 7F, which can be typically conveniently used by an end-user.

Figure 9A:
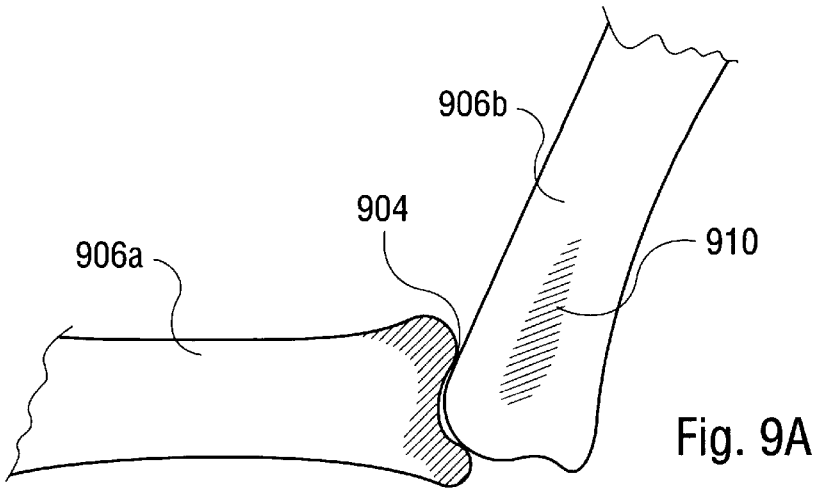
FIGS. 9A and 9B are partial side views of movable furniture frames according to an embodiment present invention.
Figure 9B:
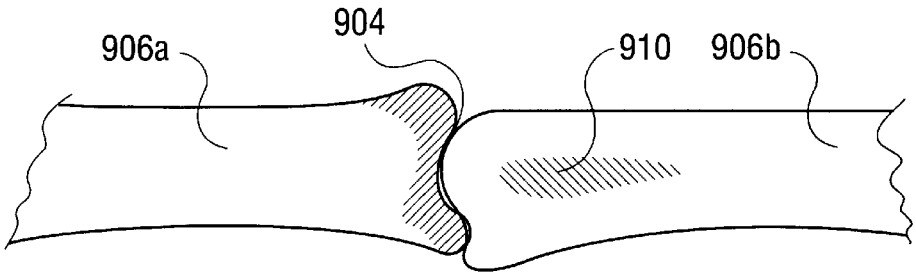
Figure 9D:
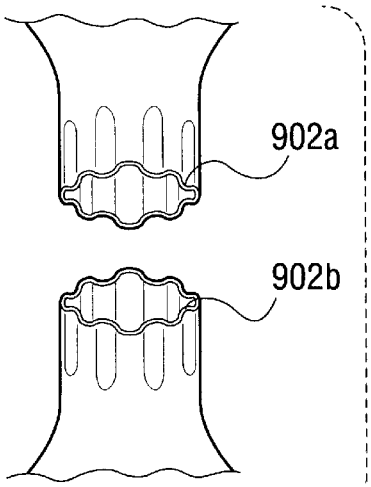
FIG. 9D is a perspective view of a movable furniture frame joint according to an embodiment of the present invention.
Figure 9C:
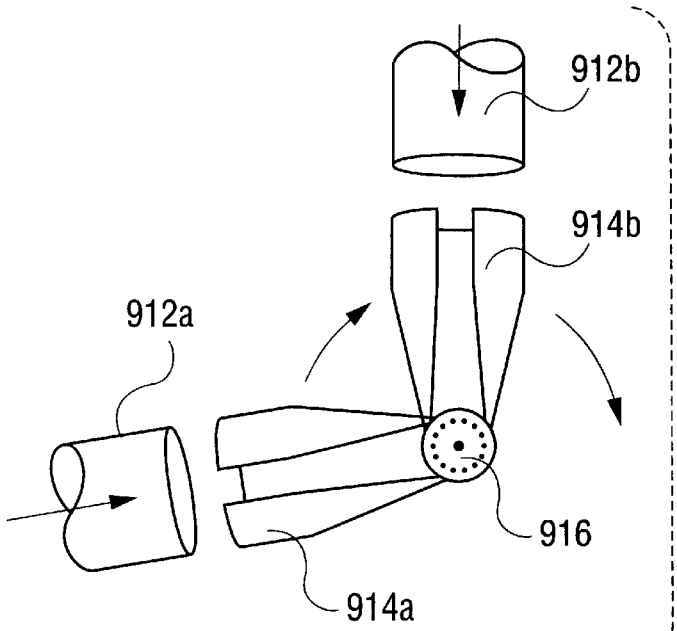
FIG. 9C is a partial side view of a joint assembly according to an embodiment of the present invention.

In one embodiment, two or more portions of the frame can be moved relative to each other to provide, e.g., moveability or collapsibility or to provide for user comfort or features, such as reclining features or reconfiguration (e.g., sofa bed) features. Such capabilities generally, can be very constructive in expanding the range of designs possible in furniture, and its usefulness and comfort (such as by providing an adjusting backrest) and the range of uses to which the construction might be applied (such as sofa beds and the like). The use of a molded construction is widely advantageous in the design and production of movable furniture. For molded shell-structure frames, forms descriptive of a lattice form, and especially a skeletal framework, are particularly accommodative of such constructions. In one embodiment, reconfiguration can be accommodated by providing interchangeable parts, such as substituting a first backrest 602 having a first lumbar shape for a second backrest 604 having a second lumbar shape. Reconfiguration or other types of movement can also be implemented providing relative movement of frame components. A number of types of movement can be accommodated such as telescoping or other linear movement, relative sliding movement, bellows or accordion-type movement, linkage-controlled movement, cam or lever movement and the like. Rotation movement is particularly useful in furniture frames. Rotation may be directly along a longitudinal axis (FIG. 9D), or about a normal axis (FIGS. 9A, 9B and 9C).

Rotation movement can also be simultaneously both along a longitudinal axis and about a normal axis.

Rotation along a longitudinal axis may be controlled by, e.g., stopping travel at particular points using a pull-out-and-reset option 902*a*, 902*b*, a push and release spring action countered by the shapes of the rotating form, or a pull and release spring action (similarly countered).

Among the options for joints contemplated for motion are joints analogous to those in the leg of a mantis, analogous to those in the leg of a crab, analogous to joints between bones such as the hip joint or elbow joint in the human body, analogous to joints in the human spine (i.e., in the joining action between vertebrae), and the like.

As depicted in FIGS. 9A and 9B, a knuckle joint provides for end members contoured to fit a curved knuckle surface 904, and held in compression thereagainst, e.g., by a tensioning element which may be, e.g., internal to the shell-structure components 906*a*, 906*b*.

Joints may also be held together through shaping and joining one part within another. Preferably, the regions nearest to joints are reinforced, e.g., through structural shape, such as externally contoured with concavities 910. Reinforcement in regions nearest joints can also be achieved through other variations in structural shape and/or through the material composition of the shell-structure (e.g, through enhanced material distribution in the region of the joint). Material composition within joint regions may also define solid articles (or substantially solid articles, as may be characterized with a use of some engineered foam constructions) such that progressively merge to form shell-structure forms (a composition not dissimilar to that in many bones, such as in the thigh bone of the human leg). Preferably, enhanced structural strength in joint regions is integrally distributed through the shell-structure forms beyond the area of the joint for a maximized distribution of stress. In some instances, as appropriate, friction-reducing surfaces may be applied to areas of direct contact between joints. The joint portion of the frames can be made separately and then assembled to the seat frame. The joint portion of the frames can be made by integrating mechanical parts of a conventional type within the joint assembly (FIG. 9C). In the device depicted in FIG. 9C, the shell-structure 912*a*, 912*b*, which can be, e.g., stamped, are joined to the plates 914*a*, 914*b*, with ball bearings encased 916. Travel in joints may be controlled by a mechanical device within the joint area such as a gear mechanism, or by the shape of the shell walls in the area of the joint. In one embodiment, stresses arising in the region of the joint are distributed through adjacent structural forms in a fashion analogous to the distribution of stress in the human elbow joint through a series of muscle tendons. For example, a strap-like material (or a series of such materials) may be woven through the shell-structure form. The strapping may have an elastic property which varies, e.g., longitudinally, to provide components in the seat frame with a degree of "give," and which may also be useful in further enhancing stress distribution between component parts. In one embodiment, with each rotation of the joint the strapping works its way through the form, constantly varying the areas in the strapping encountering higher than average stress and thus extending the life-span of the strapping. In one embodiment, the shell-structure form is particularly shaped to accommodate the strapping and/or its travel (e.g., with depressions or shaped recesses within the shell-structure form). Travel in joints may be controlled by regulation of the travel of the strapping via spring tension or friction on its surface, or by incorporating into the strapping a device, e.g., a shaped article, designed to lock in position at various stages in its travel through the form, e.g., as various shapes within the shell-structure form are encountered. Shapes within the shell-structure may be further designed to actuate a mechanism within the device, such as a counter, as to further monitor and regulate travel.

Being a molded seat frame, the frame structure readily accommodates, and by novel means, therapeutic devices such as massagers, vibrating devices, pneumatic support devices and controls, and the like.

As depicted in FIGS. 4A–4C and 5A–5C, fabric and/or padding and/or other upholstery and/or suspension materials and devices can be coupled to the seat frame, if desired, in a number of fashions. The elements usually comprising an upholstered seat frame, in addition to the seat frame itself, are suspension, foam or padding, and upholstery material. In some instances these elements can be merged, such as in the case of an upholstery material joined to a foam part in a discrete molding of the foam part, and such as in the case of a skin formed on a foam part in a discrete molding of it, a skin that may be additionally textured, colored, etc. The absorption properties of discretely molded foam parts can be engineered through such methods as depressions of varying shapes and sizes in the foam part, and composition of the foam density, so as to create a very refined and engineered sitting experience. Foam parts may in some instances appropriate the absorption properties of a suspension.

In traditional upholstered furniture, suspension is usually made with springs. Often suspension is coupled directly to frames using methods such as stapling, which decrease recyclability of the upholstered seat frame, and are further less than optimal for use with molded seat frames, particularly molded seat frames of materials such as many plastics, steel, etc. It is preferred in the present invention to employ strapping and/or elastic material for suspension. Rather than coupling directly to the seat frame, it is preferred in the present invention to couple the suspension to the seat frame by fastening it to itself, such as by wrapping fully or partially around a span. This provides further advantages in that the suspension remains independent of the material of which the frame is made. Preferably the user may adjust tension in the suspension so as to acquire desired seating properties, or as to compensate for any sagging in the suspension material over time. Detailed absorption properties may be engineered into the suspension, such as through the properties within the fabric material comprising it. Foam or padding parts may be attached to the suspension and/or elastic material, e.g., by a hook and loop material. In providing a frame having forms that are scaled and contoured, such as are wanted for upholstered furniture, the suspension material can be more easily stretched over the seat frame and adjusted, and have reduced wear.

In most upholstered seat frames the foam that is used is produced in blocks that are cut into rectilinear sections. Such rectilinear foam sections are appropriate for use with conventional seat frames, but are more limited for use with complex or non-rectilinear shapes, e.g. as may characterize many molded shapes. Foam also is often attached to seat frames directly through gluing. Preferably, in the present invention, the foam parts are made in individual (discrete) molds. As noted before, this provides enhanced opportunities for engineering the composition of the foam parts. A batting material or other fabric material can be joined with the foam parts, including in the foaming process, and be used to wrap sections of the seat frame, thus holding the foam parts in place. Foam parts can be compressed and shipped flat. Foam parts can be transported unconstructed and be molded directly by the end user. In one embodiment, some or all of the foam or padding-like properties are incorporated into the shell-structure frame in the process of molding.

In attaching upholstery material a range of detachable fittings can be used such as Velcro, snap fittings, buttons, zippers and the like.

Figure 4A:
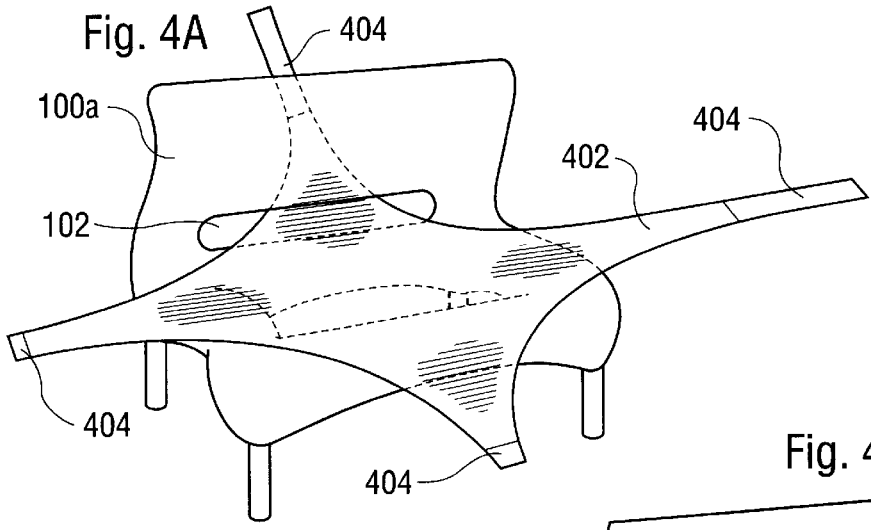
FIGS. 4A through 4C are perspective views, partially exploded and partially in phantom of upholstered furniture according to aspects of the present invention.
Figure 4B:
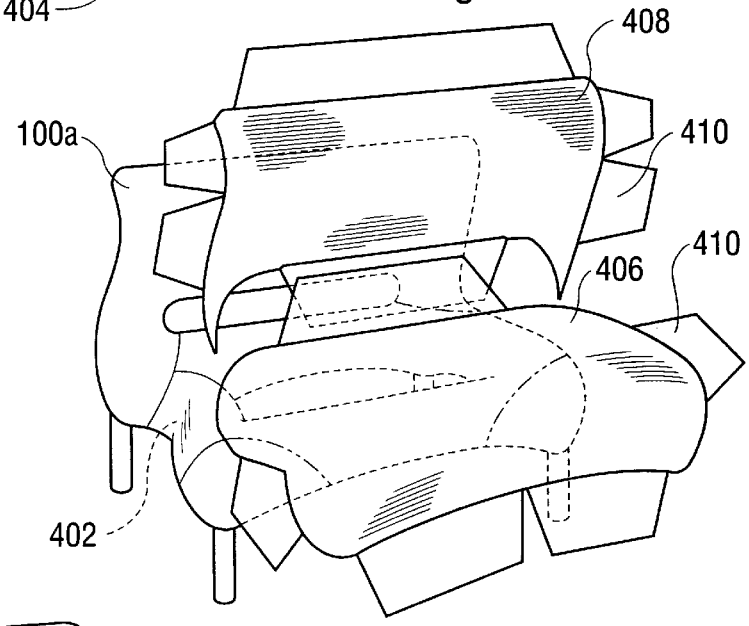
Figure 4C:
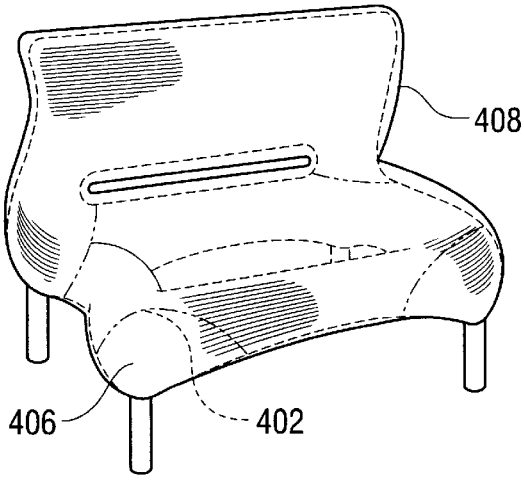
Figure 5A:
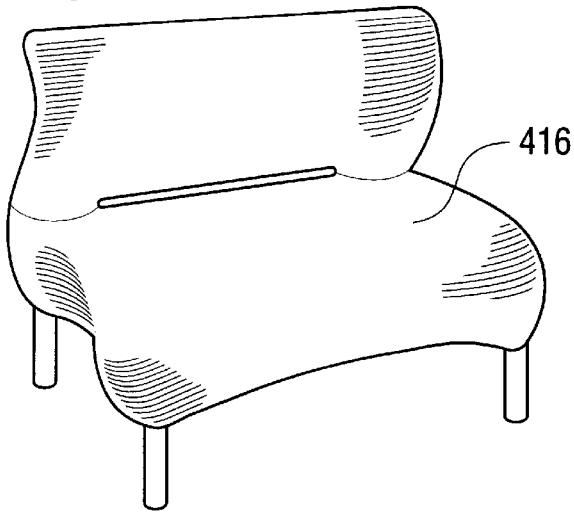
FIGS. 5A through 5C are perspective views of upholstered furniture according to embodiments of the present invention.
Figure 5B:
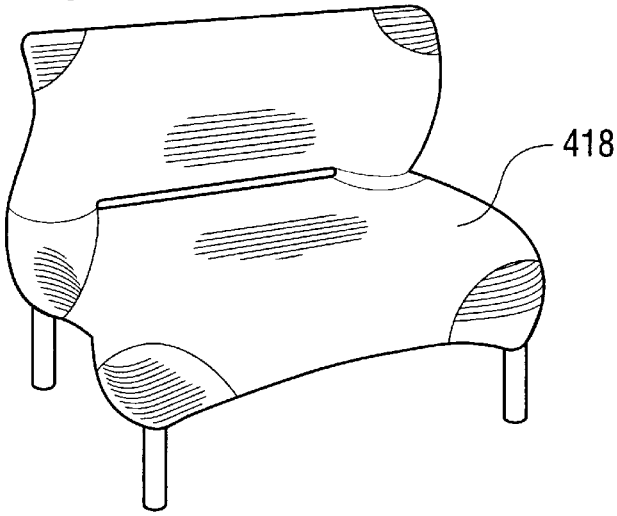
Figure 5C:
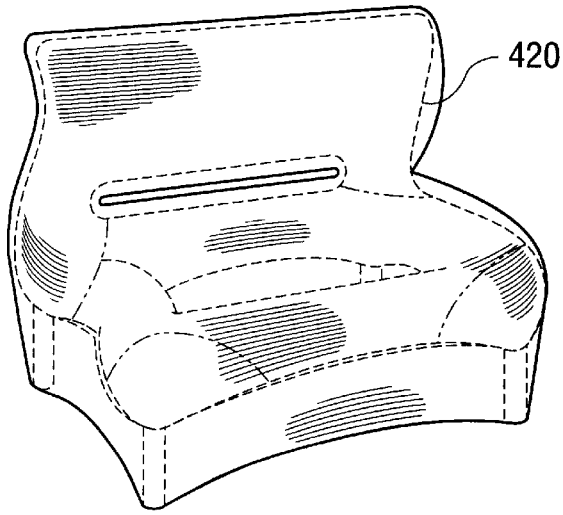

In the embodiment of FIG. 4A, a suspension material 402, such as a fabric or elastic material, covers and spans a frame and/or frame opening 102 and is held in place by coupling to itself, e.g., using a buckle type device. Coupling the material to itself is accommodated by wrapping portions 404 of the material around frame spans which define the openings 102 and/or inserting some or all portions of the material through opening 102. After the suspension material 402 is coupled to the frame 100*a*, a final upholstery and/or padding component 406, 408 can be coupled to the frame 100*a*, e.g., with batting material or other fabric material wrapping the frame and having hook and loop tabs 410 to achieve the final upholstered furniture depicted in FIG. 4C.

Other shapes and configurations of upholstery can be coupled to achieve different furniture dressings for a single given frame, preferably adjustable and interchangeable by the user to provide different appearances 416, 418, 420. Preferably, the upholstery and/or suspension and/or foam or padding parts is readily adjustable by the user, e.g., by releasing and reattaching hook and loop or other attachment devices and materials. Suspension material 402, by being adjustable, can provide for different levels of resiliency as preferred by the end user. In one embodiment, the fabric material contains portions having hook and loop tabs 410 which extend over the side of the foam parts and are used to fasten the upholstery and/or foam to the frame and/or to the suspension. In one embodiment, the foam parts are produced in individual molds and are shaped specifically to conform to a given frame contour.

In light of the above description, a number of advantages to the present invention can be seen. The elements of the upholstered seat frame are readily put together and taken apart by the user, interchanged and adjusted. The seat frame is a flexible and dynamic platform with which the user can interact. The assembly of the upholstered seat frame can be simplified and consistency of quality of the assembly can be further enhanced. Production of the upholstered seat frame need not be centralized prior to distribution. The elements of the upholstered seat frame can be produced at separate locations and assembled at the retail outlet or shipped separately to the consumer. Inventory costs can be reduced as the elements of the upholstered seat frame are not lastingly joined and the producer or retailer need not wager on a single configuration or design. A large number of options are available in packaging and transport generally. Replacement parts for elements comprising the upholstered seat frame are more accessible, and by such means the useful life of the upholstered seat frame can be extended. Having the elements comprised in the upholstered seat frame be adjustable, where feasible, can also extend the useful life of the upholstered seat frame.

The upholstered seat frame can be much more convenient in use as regards cleaning and the like. The recyclability of the upholstered seat frame is very significantly improved, reflecting the principle of design for disassembly. The ability to customize the upholstered seat frame is enhanced, making practical custom furniture available "to go." The enhanced ability to customize the upholstered seat frame greatly expands the potential for individual expression and the ability to satisfy diverse tastes. The enhanced ability to customize allows various price points in the market to be accessed through different configurations, broadening the market for the producer.

The elements of the upholstered seat frame are highly engineerable; the upholstered seat frame is a highly engineered construct; the user has wide discretion in selecting the engineered properties of the upholstered seat frame.

The elements of the upholstered seat frame are very designable. The upholstered seat frame is a very designed construct and the user has wide discretion in selecting the design characteristics of the upholstered seat frame.

Being a molded seat frame, the seat frame avoids the constraints and disadvantages of conventional materials and processes, can provide higher quality and greater value at modest or reduced cost, can reduce the amount of pre-processing of materials required, the amount of assembly required and the amount of labor required, can be produced with consistent product quality, increases the range of properties that can be engineered into the seat frame, reduces the need to adhere to strict perpendicularity, can increase strength and durability, increases design capabilities, reduces the need to incline to a rigid rectilinear format, provides for ease in accommodating ergonomic features, can increase the ability to recycle, can readily provide forms that are well-suited for upholstered furniture, particularly forms having surfaces that are less lean, less narrow, i.e. broader and/or fuller than in typical upholstered seat frames, and forms that are less rectangular, less sharp-edged, i.e. more rounded and blunter of edge than in typical upholstered seat frames, can reduce the need for foam and/or padding, can increase the useful life of upholstery and the range of materials that can be used for upholstery, can increase the ease of transportation of the seat frame and/or components, increases options for interesting and/or stacking of the seat frame and/or components, provides for ease of designing and using knock-down furniture and/or components, provides for ease of designing or using furniture with motion and/or therapeutic or comfort capabilities, allows the designer or manufacturer to realize the benefits of modern design and manufacturing tools, and/or increases the range of available design choices, including custom design capabilities.

Being a shell-structure molded seat frame, the seat frame can more readily provide a molded seat frame having considerable integration in structural strength, can provide a molded seat frame having forms being well-suited for upholstered furniture that also increase the structural properties of the molded seat frame, provides strong, structurally integrated joints, that can be facilely disassembled and reassembled, provides increased options for a stacking or internesting of disassembled portions of the molded seat frame, increases the range of molding processes that can be utilized in the manufacture of the molded seat frame, provides low-cost molding processes using lower-cost molds and molding machinery, reducing the costs for large molds such as for two-seat or three-seat frames, reducing the size of production runs required to recoup mold costs and increasing design flexibility for producers and the ability to avoid cliched designs, increasing the number of molds producers can affordably keep on hand and increasing the ability of producers to affordably provide frames or components of frames in varying sizes, in varying versions, with varying ergonomic features and the like, provides lowpressure, low-cost molding processes allowing lighter and thinner molds, allowing faster cooling of material as applicable, and very lightweight molds having strength mirroring that of the shell-structure molded article, and molding processes incorporating complex inter-inflatable moldable forms, and innovative molding processes such as molds that are an inflatable article, increases the materials available for use in the molded seat frame, including alternatives to plastics probably more appropriate for use indoors, and in homes in the form of upholstered furniture, increases flexibility for the producer of the molded seat frame through the ability to choose among molding processes and materials, or molding contractors and material suppliers, provides molding processes that generally reduce cast-in stresses in the molded seat frame, reducing the probability of stress-cracking and increasing the useful life of the seat frame, provides molding process in which engineering capacity is furthered, provides molding processes that can readily produce lightweight closed-forms (closed shell construction shell-structures), provides molding processes in which the forms being well-suited for upholstered furniture further the distribution of material in the molding process and facilitate the pulling of finished parts from molds.

Being a shell-structure molded seat frame of the present configuration, the seat frame provides an effective use of shell-structure strength in assuming compressive loading on the seat frame, increases the breadth of spans shell-structure molded seat frames are capable of traversing, and the loads they are capable of assuming, without undue excess of material, increases the range of designs and uses available to shell-structure molded seat frames, increases the durability or life-span of shell-structure molded seat frames, increases the materials being available for use in shell-structure molded seat frames, provides a seat frame exceptionally well-suited for use in upholstered furniture, provides a seat frame having recessed or open area beneath the seat area accommodating of a suspension, provides a seat frame accommodating a suspension comprised of a fabric material which can wrap around all sides of the seat portion of the seat frame, provides a seat frame having multiple options for upholstering, increases opportunities for assembly and disassembly of the seat frame, increases the options available in the packaging and transport of the seat frame, increases the options for an interchanging of parts or sections of the seat frame, provides for movable parts or sections to be readily incorporated in the seat frame, provides the advantages of the light weight and efficient material use of space-frames for carrying compressive loads, provides the advantages of the light weight and efficient material use of space-frames for carrying compressive loads joined with the efficiency of shell-structures for resisting shear and torsion, provides a seat frame defining a space-frame and being scaled and contoured to enhance the properties of the seat frame for use in upholstered furniture while also providing a seat frame having exceptional structural integration and torsional strength, provides a seat frame having the added design and engineering flexibility provided by space-frames for selectively positioned structural members, provides a seat frame having the added design and engineering flexibility of structural strength in individual structural members being selectively described.

In one embodiment, the present invention comprises furniture for seating having a frame (preferably three-dimensional and preferably adult-sized), where the seat frame largely is comprised of one or more molded components, where the molded components are largely shell-structure, and where a lattice form is defined by the molded components around a recessed or open area within the seat portion of the seat frame. Preferably, the lattice form defined has the character of a skeletal framework. Preferably, the molded components are scaled and contoured. Preferably, scaling and contouring provides substantial structural integration and torsional strength in the structure defined by the molded components. Preferably, the lattice form defines a lattice structure. Preferably, the lattice form defines a lattice structure in the form of a space-frame. Preferably, substantially all of the weight-bearing portions of the frame are molded components.

In one embodiment the lattice form is provided in a plurality form. In one embodiment the frame is an openwork. In one embodiment the frame is a closed shell construction shell-structure. "Depth" and "orientation" are particularly useful for shell-structures specifically. In one embodiment the depth of the molded components are orientated so as to maximize strength for assuming bending loading. In one embodiment the depth of the shell-structure is increased in the center of a span. In one embodiment the shell-structure is shaped to transfer loads to points of distribution. In one embodiment, ergonomics are incorporated in the molded components, e.g. lumbar support. In one embodiment the frame is custom fit to a user. In one embodiment, scaling of the seat frame is custom fit to the user. In one embodiment, flexibility is incorporated into the molded components. In one embodiment, foam or padding-like properties are incorporated in the molded components during the molding process. Preferably, individual seat frames or components can be stacked or internested and the molded components are disassemblable, preferably with stacking or internesting of disassemblable parts or sections and/or interchangeability of parts or sections.

In one embodiment, the seat frame incorporates moveable parts or sections. Joints can be formed integral to the molded components. Joints can be controlled using strapping or tension devices. In one embodiment the seat frame incorporates devices or techniques for massage, pneumatic variable body support, heating, etc.

Preferably the shell-structure molded seat frame is produced with a molding process which is intrinsically descriptive of shell-structures. In one embodiment low-pressure molding processes are used, possibly with supplemental inter-inflatable forms, and possibly with moldable inflatable forms. Molding processes may include rotational molding, stamped-in, high-tensile steel, stamped-in slush molding, foam molding and/or spray molding.

Upholstery elements are preferably readily put together and taken apart by the user, readily adjustable by the user, and readily interchanged by the user. Preferably, suspension material wraps a portion of the seat frame and joins to itself. Preferably, suspension material passes through an opening defined in the inner region of the seat frame. Preferably, suspension fabric material is adjustable, resilient, possibly with variable resilience, and contains an attachment such as a buckle. In one embodiment, foam parts are produced in individual molds. Fabric material may extend over the sides of the foam parts and be used to fasten them in place on the seat frame. The density of foam parts may be engineered in the molding process. Upholstery materials define space in the seat frame in varied ways with a plurality of formats of dress, preferably with upholstery materials spanning or encircling parts of the frame. Preferably, detachable fittings are used in attaching the upholstering materials.

A number of variations and modifications in the invention can be used. It is possible to use some aspects of the invention without using others. For example, it is possible to provide a shell-structure molded seat frame defining a lattice form around a recessed or open area within the seat without providing upholstery. Although the present invention has been described in connection with seating furniture, other furniture can also make use of the present invention including day-beds, beds or fold-up bed portion of the seat frame.

Although the present invention has been described by way of preferred embodiments and certain variations of modifications, other variations of modifications can also be used. The invention being defined by the following claims.

What is claimed is:

1. A furniture for use by at least one human user, said human user having weight, said human user having a buttocks region, said furniture for seating above a support surface, the furniture having a main loading area, the main loading area being a substantially horizontal seat portion, said furniture comprising:

a weight-bearing frame, wherein a larger portion of the frame has one or more molded components, wherein said weight-bearing frame defines at least one span across a part of said substantially horizontal seat portion;

wherein at least 50% of said molded components are shell-structure, at least a portion of said shell structure traversing said span across a part of said seat portion;

wherein a lattice form having a character of a skeletal framework is defined by said molded components and is positioned in said seat portion; and wherein a part of said shell structure is positioned completely around at least one of a recessed and open area defined by said lattice form within said main loading area having said seat portion, said at least one of recessed and open area positioned and sized at least sufficiently to accommodate said buttocks region of at least one user, said part of said shell structure which is positioned completely around said at least one of recessed open area defining a substantially horizontal plane, said part of said shell structure assuming compressive loading placed on said substantially horizontal seat portion by which the weight of said at least one human user is transferred to the support surface.

2. The furniture in claim 1, wherein said lattice form defines a lattice structure.

3. The furniture, as claimed in claim 1, wherein said lattice form defines a lattice structure which is a space-frame.

4. The furniture, as claimed in claim 1, wherein said molded components are scaled.

5. The furniture, as claimed in claim 4, wherein said molded components are contoured.

6. The furniture, as claimed in claim 5, wherein said molded components are generously contoured.

7. The furniture, as claimed in claim 6, wherein a structure defined by said molded components has substantial structural integration and torsional strength.

8. The furniture, as claimed in claim 7, wherein a structure defined by said molded components is an optimized structure.

9. The furniture, as claimed in claim 7, wherein a structure defined by said molded components is an efficient structure.

10. The furniture, as claimed in claim 1, wherein substantially all weight-bearing portions of said frame are molded components.

11. The furniture, as claimed in claim 1, wherein said lattice form defined is plural.

12. The furniture, as claimed in claim 1, wherein said frame is an openwork.

13. The furniture, as claimed in claim 1, wherein substantially a majority of said molded components are closed shell construction shell-structure.

14. The furniture, as claimed in claim 1, wherein said molded components are substantially all closed shell construction shell-structure.

15. The furniture, as claimed in claim 1, wherein said furniture is at least partially upholstered.

16. The furniture, as claimed in claim 1, wherein said furniture is substantially upholstered.

17. The furniture, as claimed in claim 1, wherein said shell-structure molded components define at least a first depth, said first depth orientated to provide strength for assuming bending loading greater than strength obtained from at least some other orientation of said depth.

18. The furniture, as claimed in claim 17, wherein said first depth is oriented to substantially maximize strength.

19. The furniture, as claimed in claim 1, wherein at least a first portion of said frame defines load-bearing span having a first shell-structure molded component, and wherein said first shell-structure molded component has a first depth substantially near the center of said span which is greater than a depth of said shell-structure molded component spaced from said center of said span.

20. The furniture, as claimed in claim 1, wherein molded components are shaped to transfer loads to regions of load distribution.

21. The furniture as claimed in claim 1, wherein molded components are ergonomically shaped.

22. The furniture as claimed in claim 1, wherein molded components are shaped to provide lumbar support.

23. The furniture, as claimed in claim 1, wherein at least a portion of said frame is custom fit to a user.

24. The furniture, as claimed in claim 1, wherein at least a portion of said frame is custom scaled to a user.

25. The furniture as claimed in claim 1, wherein at least a portion of said molded components are substantially flexible.

26. The furniture as claimed in claim 1, wherein at least one of said molded components includes a surface having a padding property incorporated during a molding process.

27. The furniture as claimed in claim 1, wherein said frame is contoured to accommodate stacking with similar frames.

28. The furniture as claimed as claim 1, wherein said frame is contoured to accommodate inter-nesting with similar frames.

29. The furniture as claimed in claim 1, wherein said frame comprises a plurality of disassemblable sections.

30. The furniture as claimed in claim 29, wherein at least some of said disassemblable sections are configured to accommodate stacking.

31. The furniture as claimed in claim 29, wherein at least some of said sections are configured to accommodate inter-nesting.

32. The furniture as claimed in claim 29, wherein at least two of said sections are interchangeable.

33. The furniture as claimed in claim 1, wherein at least two sections of said frame are configured so as to be movable with respect to one another during normal use.

34. The furniture as claimed in claim 33, further comprising means for controlling said relative movement.

35. The furniture as claimed in claim 1, wherein said frame includes at least a first knuckle joint.

36. The furniture as claimed in claim 1, wherein said frame includes at least a first joint providing relative movement of portions of said frame, said joint being integral to said molded components.

37. The furniture as claimed in claim 36 wherein said strapping provides a function selected from the group consisting of motion control and stress distribution.

38. The furniture as claimed in claim 1, wherein said frame includes at least a first joint providing relative movement of portions of said frame, said joint being non-integral with and coupled to said molded components.

39. The furniture as claimed in claim 1, further comprising strapping coupled to said frame.

40. The furniture as claimed in claim 1, further comprising strapping at least partially covering a first opening defined by said lattice form.

41. The furniture claimed in claim 1, further comprising strapping coupled to said frame by at least partially wrapping around a frame component adjacent to at least one opening defined by said lattice form.

42. The furniture as claimed in claim 1, wherein said frame includes means for providing a therapeutic service selected from the group consisting of massage, pneumatic variable body support and heating.

43. The furniture as claimed in claim 1, wherein at least one of said molded components is produced by a molding process which is intrinsically descriptive of shell-structures.

44. The furniture as claimed in claim 43, wherein at least one of said molded components is produced by a low-pressure molding process.

45. The furniture as claimed in claim 44, wherein at least one of said components is produced by a low-pressure molding process which uses supplemental inflatable forms.

46. The furniture as claimed in claim 44, wherein at least one of said molded components is produced in a molding process using inflatable molds.

47. The furniture as claimed in claim 1, further comprising upholstery configured to be manipulated by a user to perform a function selected from the group consisting of assembly, disassembly, adjustment and interchange.

48. The furniture as claimed in claim 1, further comprising a suspension material coupled to said frame.

49. The furniture as claimed in claim 48, wherein said suspension material is coupled to said frame by passing through an opening defined in an inner region of said frame.

50. The furniture as claimed in claim 48, wherein said suspension material is coupled to said frame by being joined to itself.

51. The furniture as claimed in claim 48, wherein said suspension material is a fabric.

52. The furniture as claimed in claim 48, wherein tension on said suspension material is adjustable.

53. The furniture as claimed in claim 48, wherein said suspension material is substantially resilient.

54. The furniture as claimed in claim 48, wherein said suspension material has resilience which is user-variable.

55. The furniture as claimed in claim 48, wherein resilience properties of said suspension material are spatially variable.

56. The furniture as claimed in claim 48, wherein said suspension material is coupled to said frame by a buckle-type device.

57. The furniture as claimed in claim 1, further comprising at least a first material with padding properties coupled to said frame.

58. The furniture as claimed in claim 57, wherein said first material is produced in individual molds.

59. The furniture as claimed in claim 57, wherein said first material is coupled to said seat frame using a fabric material extending over at least a first side of said first material.

60. The furniture as claimed in claim 57, wherein said first material has a density which is determined during a molding process.

61. The furniture as claimed in claim 59, wherein said fabric material is joined to said first material in a molding process.

62. The furniture as claimed in claim 1, further comprising upholstery detachably coupled to said frame.

63. A furniture for use by at least one human users, said human user having a weight and a buttocks region, said furniture provide for seating above a support surface, the furniture having a main loading area, the main loading area being a substantially horizontal seat portion, said furniture comprising:

frame means for supporting bearing weight of a user wherein at least 50% of said frame is composed of one or more molded components, wherein said weight-bearing frame means defines at least one span across a part of said substantially horizontal seat portion;

upholstery detachably coupled to said frame means;

wherein at least 50% of said molded components are shell-structure, at least a portion of said shell structure traversing said span across a part of said seat portion;

wherein a lattice form is defined by said molded components and is positioned in said seat portion; and wherein a part of said shell structure is positioned completely around at least one of a recessed and open area defined by said lattice form within said main loading area comprising said seat portion, said at least one of a recessed and open area being positioned and sized at least sufficiently to accommodate said buttocks region of said at least one user, said part of said shell structure which is positioned completely around said at least one of a recessed and open area defining a substantially horizontal plane, said part of said shell structure assuming compressive loading placed on said substantially horizontal seat portion by which the weight of said at least one human user is transferred to the support surface.

64. The furniture, as claimed in claim 1, wherein at least one of said molded components is produced by a molding process selected from the group consisting of blow molding, rotational molding and foam-molding.

65. The furniture, as claimed in claim 1, wherein shell interior space defined by said shell structure is substantially continuous throughout the larger portion of said frame.

66. The furniture, as claimed in claim 1, wherein said horizontal seat portion is supported by a shell-structure leg portion which is substantially integrated therewith.

67. The furniture, as claimed in claim 66, wherein said integrated seat and leg portions provides continuity of shell structure strength.

68. The furniture, as claimed in claim 1, wherein said seat portion is formed integrally with at least one of a back portion and a leg portion.

69. A furniture for seating comprising:

a weight-bearing frame for supporting the weight of one or more users for seating above a support surface, said frame having a main loading area, said main loading area being a substantially horizontal seat portion, wherein said main loading area assumes compressive loading from the weight of said one or more users placed on said seat portion from above, said frame defining at least one span across a part of said substantially horizontal seat portion;

wherein a larger part of said frame is one or more molded components;

wherein a larger part of said molded components is shell-structure; and wherein said seat portion is largely a lattice form, said lattice form defining at least one of a recessed and open area within said seat portion, wherein said lattice form is largely defined by said molded components.

70. The furniture, as claimed in claim 69, wherein said molded components which define said lattice form are largely shell structure.

71. The furniture, as claimed in claim 69, wherein said molded components which define said lattice form are substantially all shell structure.

72. The furniture, as claimed in claim 1 wherein said part of said shell structure defines a continuous shell interior region positioned completely around said at least one of recessed and open area.

* * * * *

UNITED STATES PATENT AND TRADEMARK OFFICE

CERTIFICATE OF CORRECTION

PATENT NO. : 6,702,391 B1
DATED : March 9, 2004
INVENTOR(S) : Stipek

It is certified that error appears in the above-identified patent and that said Letters Patent is hereby corrected as shown below:

Column 8,
Line 64, please delete the word "invent" and substitute therefor -- invention --.

Column 17,
Line 26, please delete "6E" and substitute therefore -- 6C --.

Column 24,
Line 32, between the words "furniture" and "in" please add -- as claimed --.

Column 25,
Line 59, please delete "36" and substitute therefore -- 39 --.

Column 26,
Line 66, please delete the word "users" and substitute therefore the word -- user --.

Column 27,
Line 1, please delete the word "provide".
Line 2, between the words "furniture" and "having" please add the word -- provided --.

Signed and Sealed this

Thirteenth Day of July, 2004

JON W. DUDAS
*Acting Director of the United States Patent and Trademark Office*